US008027629B2

(12) United States Patent
Tanaka

(10) Patent No.: US 8,027,629 B2
(45) Date of Patent: Sep. 27, 2011

(54) IMAGE FORMING APPARATUS AND IMAGE FORMING SYSTEM

(75) Inventor: Kenji Tanaka, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 506 days.

(21) Appl. No.: 12/315,530

(22) Filed: Dec. 3, 2008

(65) Prior Publication Data

US 2009/0142088 A1 Jun. 4, 2009

(30) Foreign Application Priority Data

Dec. 4, 2007 (JP) ..... 314009/2007

(51) Int. Cl.
*G03G 15/00* (2006.01)

(52) U.S. Cl. ..... 399/388; 399/407

(58) Field of Classification Search ..... 399/43, 399/364, 401, 408–410
See application file for complete search history.

(56) References Cited

U.S. PATENT DOCUMENTS

| | | | | |
|---|---|---|---|---|
| 5,703,693 | A * | 12/1997 | Morikawa | 358/296 |
| 5,987,300 | A | 11/1999 | Mori et al. | |
| 6,539,198 | B2 * | 3/2003 | Miyajima | 399/389 |
| 2008/0253818 | A1 * | 10/2008 | Sasaki et al. | 399/401 |

FOREIGN PATENT DOCUMENTS

| | | |
|---|---|---|
| JP | 10-339975 A | 12/1998 |
| JP | 2003-241578 | 8/2003 |
| JP | 2005-321482 | 11/2005 |
| JP | 2006-256710 | 9/2006 |

* cited by examiner

*Primary Examiner* — David Gray
*Assistant Examiner* — Gregory H Curran
(74) *Attorney, Agent, or Firm* — Edwards Angell Palmer & Dodge LLP

(57) ABSTRACT

An image forming apparatus of the present invention is arranged so that plural sheets of paper are conveyed to a main conveying path and a sub-conveying path at the time of double-side image formation. In performing double-side image formation jobs on plural sets of sheets of paper, a sequence control section makes a change of sequences for image formation so that a post-process for the previous job can be performed during image formation of the next set. With this, in performing double-side image formation jobs on plural sets of sheets of paper in an image forming system constituted by an image forming apparatus and a post-processing apparatus, images can be formed in succession without suspending image formation of the next set to allow post-processing time for the previous set. This makes it possible to achieve a system with high job efficiency.

10 Claims, 12 Drawing Sheets

IMAGE FORMING APPARATUS AND IMAGE FORMING SYSTEM

This Nonprovisional application claims priority under U.S.C. §119(a) on Patent Application No. 314009/2007 filed in Japan on Dec. 4, 2007, the entire contents of which are hereby incorporated by reference.

FIELD OF THE INVENTION

The present invention relates to a technique for improving productivity of an image forming system obtained by equipping an image forming apparatus with a post-processing apparatus.

BACKGROUND OF THE INVENTION

There are some image forming apparatus to which a post-processing apparatus can be connected as an option to perform a post-process on sheets of paper outputted from the image forming apparatus, and an image forming system is constituted by equipping the image forming apparatus with the post-processing apparatus. Examples of the post-process includes stapling sheets of paper together, outputting sheets of paper onto a designated one of a plurality of paper output trays, and offsetting a position on a paper output tray in which sheets of paper are outputted.

Patent Document 1 discloses an arrangement of such an image forming system in which an image forming apparatus starts a second image formation job without waiting for a post-processing apparatus to complete preparation for change of post-processes and the post-processing apparatus starts a post-process for the second image formation job immediately after completing the preparation for change of post-processes.

That is, after the image forming apparatus suspends the conveyance of sheets of paper on completion of a first image formation job (i.e., the image formation job that came immediately before the second image formation job), the image forming apparatus resumes the feeding and conveyance of sheets of paper at an appropriate timing prior to the completion of the preparation for change of post-processes, and then supplies sheets of paper to the post-processing apparatus at substantially the same timing as the completion of the preparation for change of post-processes.

Thus, the amount of time required between the start of the first image formation job and the completion of the post-process for the second image formation job can be made smaller than ever before.

(Patent Document 1)

Japanese Unexamined Patent Application Publication No. 321482/2005 (Tokukai 2005-321482; published on Nov. 17, 2005)

However, although the arrangement of Patent Document 1 can prevent the image forming apparatus from undesirably waiting for the post-processing apparatus to complete preparation for change of post-processes, the arrangement of Patent Document 1 cannot make it possible to curb the decline in job efficiency that is attributed to the fact that in cases where the image forming apparatus performs image formation jobs in succession, the image forming apparatus delays the start of the next image formation job and waits in order to allow post-processing time for the previous image formation job.

SUMMARY OF THE INVENTION

It is an object of the present invention to provide an image forming system, capable of improving productivity in performing a succession of image formation jobs, which does not delay image formation of the next image formation job in order to allow post-processing time for the previous image formation job, or which makes the most of performance of an image forming apparatus by minimizing the duration of a delay, if any.

In order to attain the foregoing object, an image forming apparatus of the present invention is an image forming apparatus, including (i) a paper feeding section in which a sheet of paper is stored, (ii) an image forming section for performing image formation on a sheet of paper, (iii) an output section for outputting, from the apparatus, a sheet of paper subjected to image formation, (iv) a main conveying path extending from the paper feeding section to the output section via the image forming section, and (v) a sub-conveying path through which a sheet of paper having one side finished with image formation is guided to an upstream side of the image forming section from an upstream side of the output section in the main conveying path, which constitutes an image forming system by being equipped with a post-processing apparatus for performing a post-process on a sheet of paper outputted from the output section, the image forming apparatus including: conditional judgment means (conditional judgment section) for judging whether or not conditions for image formation are as follows: (1) double-side image formation is performed, i.e., images are formed on both sides of a sheet of paper; (2) the number of sheets of paper that constitute a single set is an odd number; (3) the number of sets is not less than two; and (4) it is necessary to delay image formation of the next set in order to perform a post-process on the previous set outputted ahead; and sequence control means (sequence control section) for, when the conditional judgment means judges that double-side image formation is performed, that the number of sheets of paper of a single set is an odd number, that the number of sets is not less than two, and that it is necessary to delay image formation of the next set, making a change of sequences for performing double-side image formation on plural sets of sheets of paper in succession, so as to make it possible to perform image formation on the next set while performing a post-process on the previous set.

An image forming system of the present invention includes the image forming apparatus of the present invention and a post-processing apparatus for performing a post-process on a sheet of paper outputted from the output section.

According to this, the conditional judgment means judges whether or not conditions for image formation are as follows: (1) double-side image formation is performed, i.e., images are formed on both sides of a sheet of paper; (2) the number of sheets of paper that constitute a single set is an odd number; (3) the number of sets is not less than two; and (4) it is necessary to delay image formation of the next set in order to perform a post-process on the previous set outputted ahead.

Then, when the conditional judgment means judges that double-side image formation is performed, that the number of sheets of paper of a single set is an odd number, that the number of sets is not less than two, and that it is necessary to delay image formation of the next set, the sequence control means makes a change of sequences for performing double-side image formation on plural sets of sheets of paper in succession, so as to make it possible to perform image formation on the next set while performing a post-process on the previous set.

This makes it possible not to delay image formation of the next set (image formation job) in order to allow post-processing time for the previous set (image formation job), or to minimize the duration of a delay, if any. An image forming system constituted by such an image forming apparatus does not waste the performance of the image forming apparatus, thus enabling improvement in productivity.

The sequence control means can be easily realized, for example, by being arranged so as to include (a) timing adjustment means (timing adjustment section) for adjusting timing of feeding and conveyance of sheets of paper by controlling paper conveying mechanisms respectively provided alongside the main conveying path and the sub-conveying path and (b) order adjustment means (order adjustment section) for controlling the image forming section to adjust an order in which images are formed.

Additional objects, features, and strengths of the present invention will be made clear by the description below. Further, the advantages of the present invention will be evident from the following explanation in reference to the drawings.

DESCRIPTION OF THE EMBODIMENTS

Embodiment 1

Figure 1:
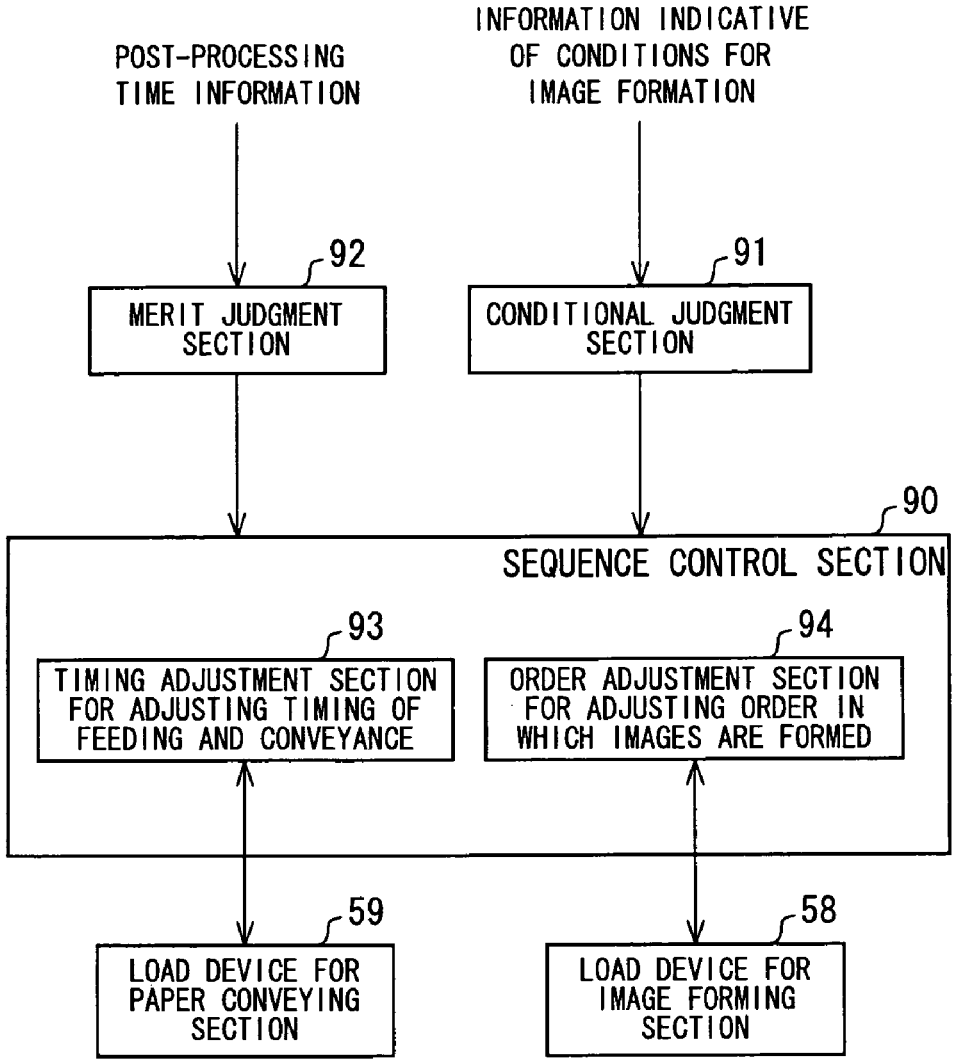
FIG. 1 is a functional block diagram that makes a change of sequences for image formation in an image forming system according to an embodiment of the present invention.

An embodiment of the present invention will be described below with reference to FIGS. 1 through 9. First, an arrangement of an image forming system 1 according to an embodiment of the present invention will be described below with reference to FIG. 2. FIG. 2 is an explanatory diagram showing the arrangement of the image forming system 1.

The image forming system 1 is constituted by equipping an image forming apparatus 2 with a post-processing apparatus 3 and two paper feeding apparatuses 4 and 5. Although the following exemplifies an arrangement in which the image forming apparatus 2 is equipped with the two paper feeding apparatuses 4 and 5 as well as the post-processing apparatus 3, an image forming system according to the present invention only needs to be constituted by equipping an image forming apparatus with at least a post-processing apparatus.

The image forming apparatus 2 forms an electrophotographic multicolor or monochrome image selectively in accordance with image data inputted through a network or the like, and then records the image on a sheet of paper. The image forming apparatus 2 includes an image forming section 6, a paper storage section 7, and a paper conveying section 8.

The image forming section 6 includes an exposure unit 10, an intermediate transfer belt 11, and a second transfer roller 14, and is constituted by disposing image forming stations 12A to 12D in a line between the exposure unit 10 and the intermediate transfer belt 11.

The image forming stations 12A to 12D form images in accordance with image information indicative of a total of four colors, namely black, cyan, magenta, and yellow, respectively. Cyan, magenta, and yellow are the subtractive primary colors, which are obtained through color separation of a color image.

The black image forming station 12A includes a photosensitive drum 101A, a developing unit 102A, a charging roller 103, a first transfer roller 104, a cleaning unit 105, and the like.

The charging roller 103 is a contact-type charger that uniformly charges a surface of the photosensitive drum 101A at a predetermined potential. The charging roller 103 may be replaced by either a contact-type charger using a charging brush, or a noncontact-type charger using a corotron or scorotron. The exposure unit 10 includes a light source such as a semiconductor laser, a polygon mirror, a reflection mirror, and the like. The exposure unit 10 irradiates the photosensitive drum 101A with image light based on black image information indicative of black, with the result that an electrostatic latent image corresponding to the image information indicative of black is formed.

The developing unit 102A supplies black toner to that surface of the photosensitive drum 101A on which the electrostatic latent image has been formed, and then develops the electrostatic latent image into a toner image. The cleaning unit 105 collects toner remaining on the surface of the photosensitive drum 101A.

The intermediate transfer belt 11 forms a loop migration pathway. The intermediate transfer belt 11 passes through a space between the photosensitive drum 101A and the first transfer roller 104 on the underside of the migration pathway.

To the first transfer roller 104, a first transfer bias whose polarity is reverse to the charging polarity of the toner is applied. The toner image formed on the photosensitive drum 101A is transferred onto an outer circumferential surface of the intermediate transfer belt 11.

Each of the cyan image forming station 12B, the magenta image forming station 12C, and the yellow image forming station 12D is arranged in the same manner as the image forming station 12A. However, the exposure units 10 irradiates the image forming stations 12B, 12C, and 12D with image light modulated in accordance with image information indicative of cyan, magenta, and yellow, respectively. Further, the image forming stations 12B, 12C, and 12D include photosensitive drums 101B, 101C, and 101D and developing units 102B, 102C, and 102D that supply cyan toner, magenta toner, and yellow toner to the photosensitive drums 101B, 101C, and 101D, respectively.

This causes a cyan toner image, a magenta toner image, and a yellow toner image to be formed on the photosensitive drums 101B, 10C, and 101D, respectively.

In the case of input of image information indicative of only some of the black, cyan, magenta, and yellow hues, only those of the four image forming stations 12A, 12B, 12C, and 12D which correspond to the hues indicated by the image information inputted form electrostatic latent images and toner images. For example, at the time of formation of a monochrome image, only the black image forming station 12A forms an electrostatic latent image and a toner image, with the result that only a black developer image is transferred onto the outer circumferential surface of the intermediate transfer belt 11.

At the time of formation of a full-color image, all of the four image forming stations 12A, 12B, 12C, and 12D form electrostatic latent images and toner images, with the result that a yellow toner image, a magenta image, a cyan toner image, and a black toner image are transferred onto the outer circumferential surface of the intermediate transfer belt 11 so as to be sequentially superimposed onto one another.

The transfer of a toner image onto the outer circumferential surface of the intermediate transfer belt 11 corresponds to the preparation of an image in the image forming section 6 of this invention.

A toner image transferred onto the outer circumferential surface of the intermediate transfer belt 11 is conveyed, by the rotation of the intermediate transfer belt 11, so as to be positioned opposite the second transfer roller 14. The second transfer roller 14 is pressed against the outer circumferential surface of the intermediate transfer belt 11 with a predetermined nip. The position where the intermediate transfer belt 11 and the second transfer roller 14 face each other is an image forming position 30 where an image is formed on a sheet of paper.

The paper storage section 7 includes paper feeding cassettes 16A and 16B and a manual paper feeding tray 17 in each of which plural sheets of paper of single variety are stored. Further, the image forming apparatus 2 is provided with the paper feeding apparatuses 4 and 5 as optional external paper storage sections.

The paper feeding apparatus 4, located below the image forming apparatus 2, contains paper feeding cassettes 16C and 16D. The paper feeding apparatus 5, located on a side surface of the image forming apparatus 2, has a large number of sheets of paper of single variety stored therein.

The paper conveying section 8 is provided with a first paper conveying path 31 extending from the paper feeding cassettes 16A and 16B to the post-processing apparatus 3, installed on an upper surface of the image forming apparatus 2, via the image forming position 30. Located alongside the paper conveying path 31 are pickup rollers 21A and 21B, paper feeding rollers 22A and 22B, a registration roller 32, a fixing unit 33, and a fourth conveying rollers 87, a first paper output roller 34, and the like.

Further, the paper conveying section 8 is provided with a second paper conveying path 35 via which the manual paper feeding tray 17 communicates with an upstream side of the registration roller 32 in a paper conveying direction of the first paper conveying path 31.

Furthermore, the paper conveying section 8 is provided with a third paper conveying path 36 (double-side conveying path) via which a space between the fixing unit 33 and the first paper output roller 34 of the first paper conveying path 31 communicates with an upstream side of the registration roller 32 in the paper conveying direction of the first paper conveying path 31. At the time of double-side image formation, i.e., at the time of formation of images on both sides of a sheet of paper, a paper sheet on one side of which an image has been formed is conveyed to the third paper conveying path 36 in a switchback manner by the reverse rotation of the first paper output roller 34.

In addition, the paper conveying path 8 is provided with a fifth paper conveying path 37 via which the paper feeding apparatus 5 communicates with the first paper conveying path 31. The paper feeding cassettes 16C and 16D of the paper feeding apparatus 4 communicate with the first paper conveying path 31 via a sixth paper conveying path 38 provided inside of the paper feeding apparatus 4. It should be noted that a more detailed arrangement of the paper conveying section 8 will be described later with reference to FIG. 4.

A sheet of paper supplied from any one of the paper storage section 7 and the paper feeding apparatuses 4 and 5 is conveyed through the first paper conveying path 31, and when the sheet of paper passes through the image forming position 30, the sheet of paper has a toner image transferred thereonto from the intermediate transfer belt 11. Further, at the time of double-side image formation, the sheet of paper having the toner image transferred thereonto is reconveyed to the first paper conveying path 31 via the third paper conveying path 36 in a switchback manner by the reverse rotation of the first paper output roller 34. Then, when the sheet of paper passes through the image forming position 30, the sheet of paper has a toner image transferred onto the other side thereof from the intermediate transfer belt 11.

The rotation of the registration roller 32, located alongside the first paper conveying path 31, is under suspension at the point of time where the head of a sheet of paper conveyed, from the paper storage section 7 (paper feeding cassette 16A or 16B or the manual paper feeding tray 17), the paper feeding apparatus 4, the paper feeding apparatus 5, or the third paper conveying path 36 reaches the registration roller 32.

Then, the rotation of the registration roller 32 starts at such timing that the head of a toner image adhering to the intermediate transfer belt 11 reaches the image forming position 30 when the head of a sheet of paper having passed through the registration roller 32 reaches the image forming position 30.

This causes a sheet of paper to be conveyed into the first paper conveying path 31 by the registration roller 32 so that the head of the sheet of paper faces the head of a toner image in the image forming position 30. It should be noted that the registration roller 32 also functions to correct skewed conveyance of a sheet of paper by making contact with the head of the sheet of paper.

A sheet of paper onto which a toner image has been transferred in the image forming position 30 is guided to the fixing unit 33. The fixing unit 33 includes a heating roller 33A whose temperature has been raised to a toner-melting temperature and a pressure roller 33B that is pressed against the heating roller 33A with a predetermined nip. The sheet of paper is heated and pressed when passing through the image forming position 30, and then outputted to the post-processing apparatus 3 with the toner image fixed onto a surface thereof.

In the image forming position 30, a toner image adhering to the circumferential surface of the intermediate transfer belt 11 should be all transferred onto the sheet of paper. However, such a toner image may partly remain on the intermediate transfer belt 11. Further, the after-mentioned process may cause a sheet of paper to pass through the image forming position 30 without transferring, onto the sheet of paper, a toner image adhering to the circumferential surface of the intermediate transfer belt 11. Such toner remaining on the intermediate transfer belt 11 after passage through the image forming position 30 is collected by a cleaning unit 13.

Meanwhile, the post-processing apparatus 3 conveys thereinto sheets of paper outputted from an option delivery outlet 85 of the image forming apparatus 2, performs a post-process on each of the sheets of paper, and stacks the sheets of paper onto a paper output tray. Examples of the post-process includes stapling sheets of paper together, outputting sheets of paper onto a designated one of a plurality of paper output trays, and offsetting a position on a paper output tray in which sheets of paper are outputted.

Figure 3:
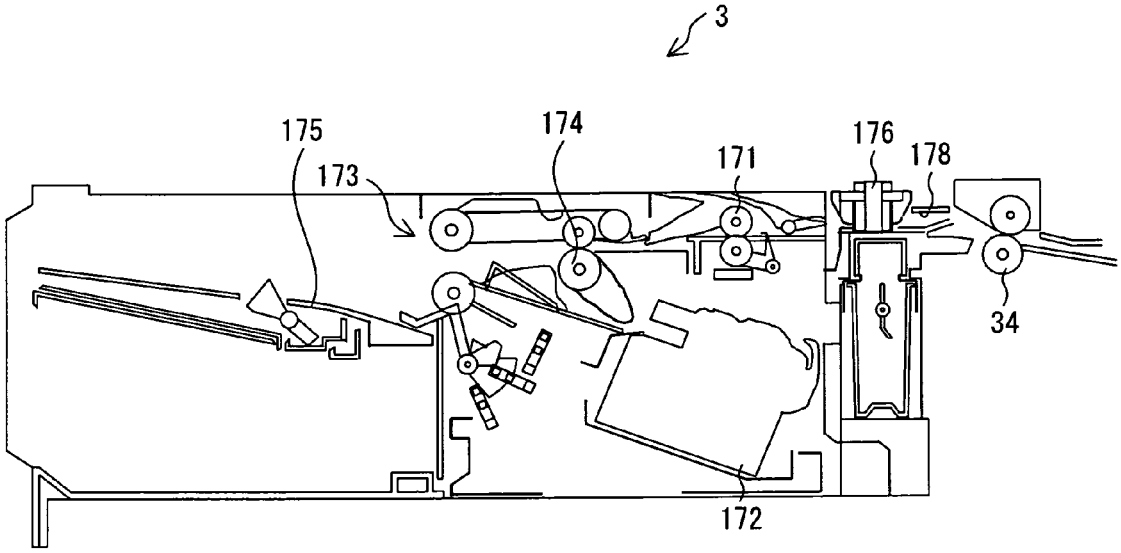
FIG. 3 shows an arrangement of a post-processing apparatus provided in the image forming system.

FIG. 3 is an enlarged view of the post-processing apparatus 3. In the present embodiment, the post-process can correspond to a stapling process of stapling sheets of paper together and a punching process of punching sheets of paper.

The post-processing apparatus 3 includes an inlet roller 171, a stapler 172, a punching pin 178, an alignment process section 173, a paper output roller 174, a sensor 176 for detecting the back end of a sheet of paper, a paper output tray 175, and the like. Sheets of paper outputted from the paper output tray 34 of the image forming apparatus 2 are conveyed to the alignment process section 173 via the inlet roller 171, and the alignment process section 173 aligns the sheets of paper sequentially stacked on a processing table. The alignment process section 173 includes an alignment plate, a paddle, a collecting belt, and the like.

In the case of a stapling process, the stapler 172 puts a staple into a designated part of a bundle of sheets of paper thus aligned. The bundle of sheets of paper thus stapled is outputted onto the paper output tray 175 via the paper output roller 174.

In the case of a punching process, the conveyance of a sheet of paper is suspended at a point of time where the sensor 176 detects the back end of the sheet of paper, and the punching pin 178 punches the back end of the sheet of paper. After that, sheets of paper conveyed to the alignment process section 173 are aligned by the alignment process section 173, and then outputted onto the paper output tray 175 via the paper output roller 174.

Figure 4:
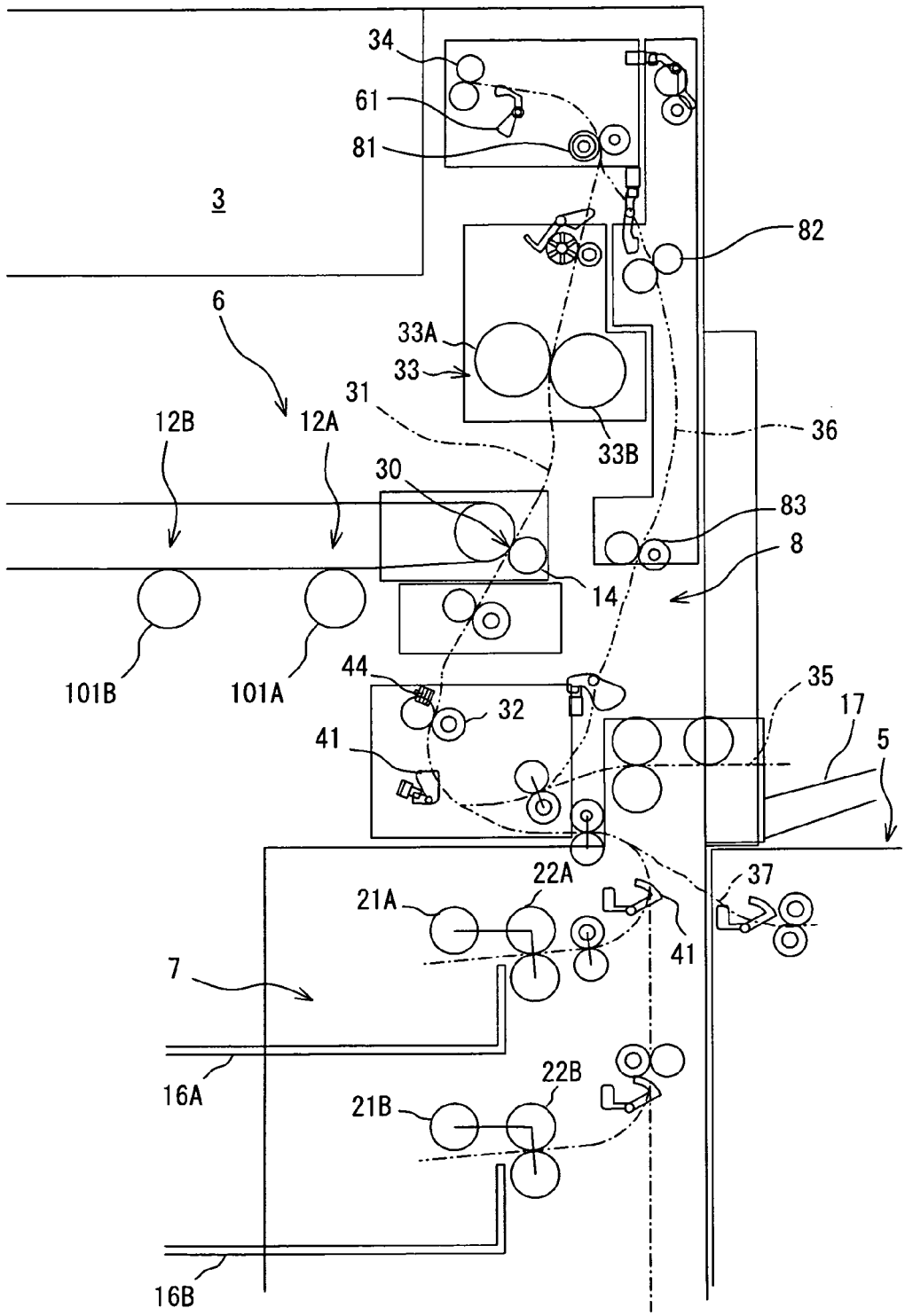
FIG. 4 shows an arrangement of a conveying path of a paper conveying section of an image forming apparatus of the image forming system.

FIG. 4 shows an arrangement of a main part of the paper conveying section 8 of the image forming apparatus 2 in the vicinity of the first paper conveying path 31.

As described above, the first paper conveying path 31 is formed inside of the image forming apparatus 2 so as to extend from the paper storage section 7 to the post-processing apparatus 3 via the image forming position 30 in the image forming section 6. Into the paper conveying path 31, sheets of paper are supplied from the respective paper feeding cassettes of the paper storage section 7 and the paper feeding apparatuses 4 and 5. Whether or not a sheet of paper has been supplied from any one of the paper feeding cassettes is detected by a paper feeding sensor 41 provided to each paper feeding cassettes.

Further, a registration sensor 44 is located in the vicinity of the registration roller 32, located alongside the first paper conveying path 31. The registration roller 44 detects whether or not the head of a sheet of paper has reached the location of the registration roller 32.

The first paper output roller (first output section) 34, located alongside the first paper conveying path 31, is arranged so as to be able to be driven to normal and reverse rotation. When driven to normal rotation, the first paper output roller 34 conveys a paper of sheet to the post-processing apparatus 3 via the option delivery outlet 85. Further, when driven to reverse rotation while clamping the back end of a sheet of paper, the first paper output roller 34 conveys the sheet of paper to the third paper conveying path 36 in a switchback manner.

Located in the vicinity of the first paper output roller 34 is a first sensor 61 for detecting the back end of a sheet of paper. The first sensor 61 detects whether or not the back end of a sheet of paper to be conveyed to the post-processing apparatus 3 has reached the first paper output roller 34. It should be noted that this specification refers to the leading end and back end of a sheet of paper in terms of the direction in which the sheet of paper is conveyed. Therefore, the leading end and back end of a sheet of paper switch positions with each other when the sheet of paper is conveyed in a switchback manner.

The third paper conveying path 36 branches off from the first paper conveying path 31 on that side of a first conveying roller 81 which faces the fixing unit 33. The first conveying roller 81 is located between the fixing unit 33 and the first paper output roller 34 alongside the first paper conveying path 31. As with the first paper output roller 34, the first conveying roller 81 is arranged so as to be able to be driven to normal and reverse rotation. When driven to normal rotation, the first conveying roller 81 conveys a sheet of paper to the first paper output roller 34. Further, when driven to reverse rotation, the first conveying roller 81 conveys, to the third paper conveying path 36, a sheet of paper conveyed in a switchback manner.

Further located alongside the third paper conveying path 36 are second and third conveying rollers 82 and 83. These second and third conveying rollers 82 and 83 rotate only in one direction to reconvey a sheet of paper to the registration roller 32.

Figure 5:
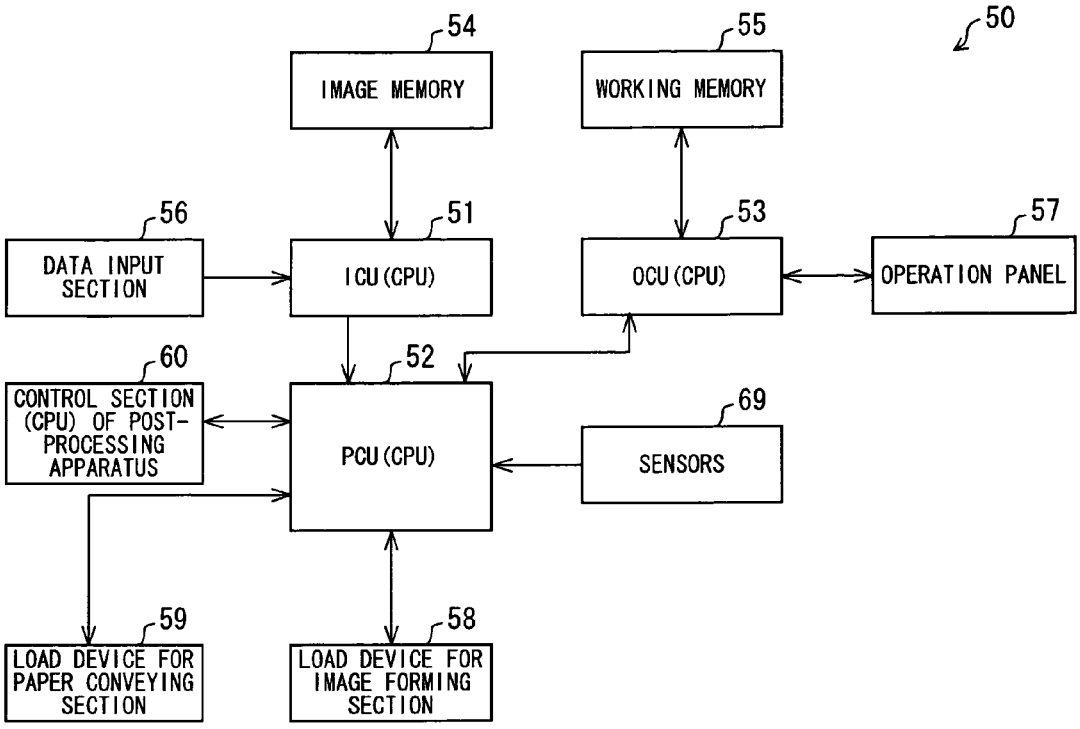
FIG. 5 is a block diagram showing an arrangement of a control section of the image forming apparatus of the image forming system.

The following describes an arrangement of a control section 50 of the image forming apparatus 2. FIG. 5 is a block diagram showing the arrangement of the control section 50 of the image forming apparatus 2. The control section 50 of the image forming apparatus 2 includes an image control unit (hereinafter referred to as "ICU") 51, a process control unit (hereinafter referred to as "PCU") 52, and an operation control unit (hereinafter referred to as "OCU") 53.

The OCU 53 includes a working memory 55, and has an operation panel 57 connected to thereto. The OCU 53 stores, in the working memory 55, operation information, such as the number of copies, the enlarging/reducing ratio, N in 1 information, density information, paper size, double-side copy information, and post-processing information, which has been inputted via the operation panel 57. Further, the OCU 53 supplies the ICU 51 with those pieces of operation information which relate to image processing with respect to image information, and supplies the PCU 52 with those pieces of operation information which relate to image formation.

The ICU 51 includes an image memory 54, and has a date input section 56 connected thereto. The ICU 51 performs, in accordance with the operation information supplied from the OCU 53, predetermined image processing for image information inputted externally via the date input section 56, and then stores the image information in the image memory 54.

Connected to the PCU 52 are load devices 58 and 59 and the post-processing apparatus 3. The load devices 58 and 59 are provided to the image forming section 6 and the paper conveying section 8, respectively, and each of the load devices 58 and 59 includes a motor, a clutch, and the like. The PCU 52 transmits, to a control section 60 of the post-processing apparatus 3, information indicative of a post-process for a sheet of paper. In the case of stapling, the post-processing information thus transmitted contains not only the content of the post-process, but also stapling positions, the number of staples to be put, and the like.

In accordance with the post-processing information sent from the PCU 52, the control section 60 of the post-processing apparatus 3 transmits, to the PCU 52, information indicative of the amount of post-processing time required to perform the post-process. The amount of post-processing time is determined in advance by the content of the post-process, the number of staples to be put, e.g., in the case of a stapling process, and whether or not to perform a punching process simultaneously.

The control section 60 of the post-processing apparatus 3 includes a table in which the content of the post-process and the amount of post-processing time are associated with each other, and transmits post-processing time information to the PCU 52 in accordance with the table. It should be noted that there can be an arrangement in which the PCU 52 includes the same table.

Further, the PCU 52 receives detection signals from various sensors 69 such as the aforementioned paper feeding sensor 41, the aforementioned registration sensor 44, and the aforementioned first sensor 61.

The PCU 52 drives the load devices 58 and 59 in the after-mentioned manner in accordance with the detection signals sent from the various sensors 69, the operation information supplied from the OCU 53, the post-processing time information inputted from the control section 60 of the post-processing apparatus 3.

The following describes an arrangement of the present image forming system 1 to which attention should be paid, i.e., a sequence change in image formation that is made at the time of double-side image formation which requires a post-process. A sequence change in image formation requires the satisfaction of all the following conditions: (1) double-side image formation is performed; (2) the number of sheets of paper that constitute a single set is an odd number; (3) the number of sets is not less than two; and (4) it is necessary to delay image formation of the next set for a post-process for the previous set.

Figure 2:
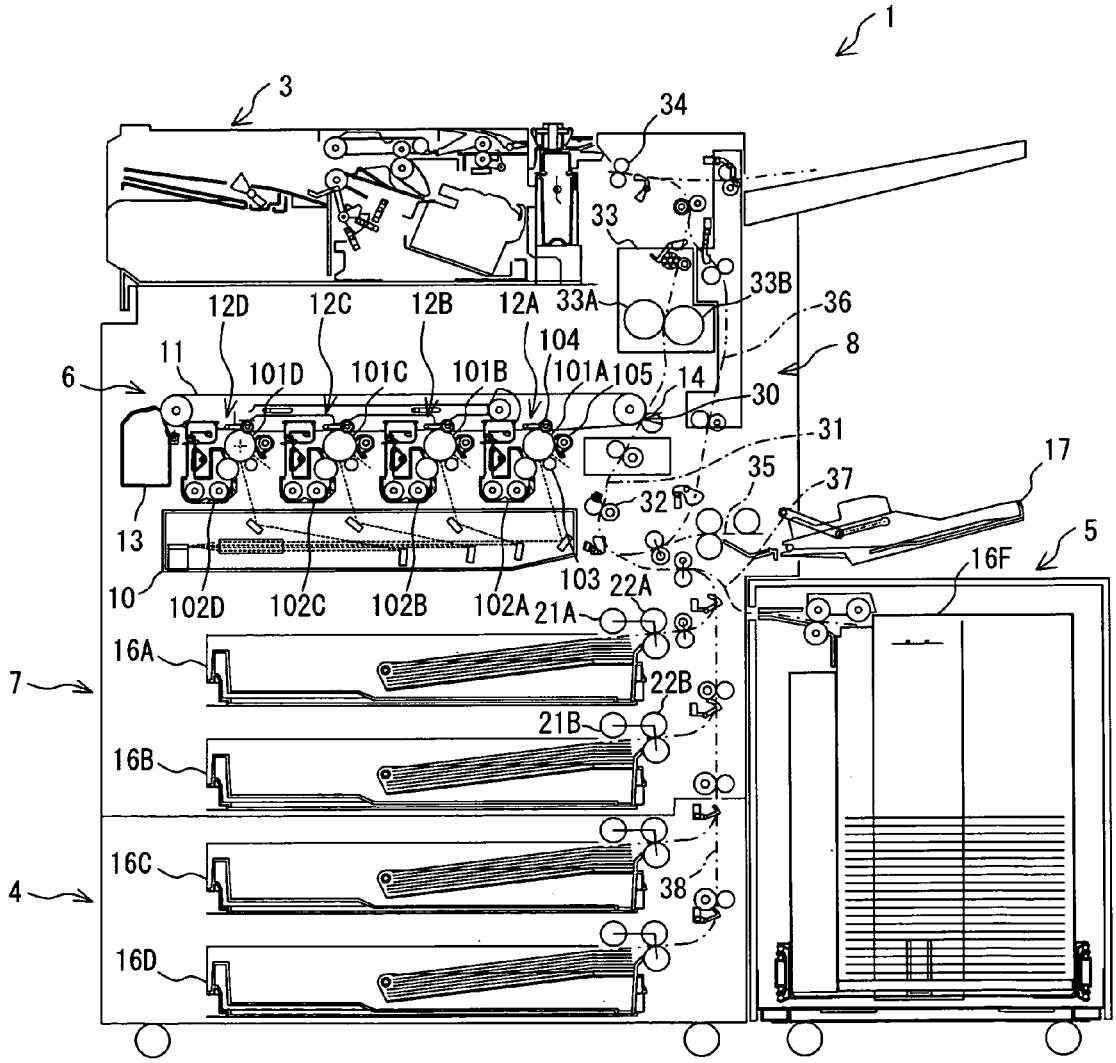
FIG. 2 shows an arrangement of the image forming system.

FIG. 1 shows a functional block diagram of a control section that realizes a change of sequences for image formation in an image forming system 1 according to the present embodiment. Included are a sequence control section (sequence control means) 90, a conditional judgment section (conditional judgment means) 91, and a merit judgment section (merit judgment means) 92. These components are constituted by the aforementioned PCU 52 and the aforementioned ICU 51.

The conditional judgment section 91 judges, from information indicative of conditions for image formation, whether or not all the following four conditions for image formation are satisfied:

Condition 1: Double-side image formation is performed, i.e., images are formed on both sides of a sheet of paper.

Condition 2: The number of sheets of paper that constitute a single set is an odd number.

Condition 3: The number of sets is not less than two.

Condition 4: It is necessary to delay image formation of the next set in order to perform a post-process on the set outputted ahead.

When the conditional judgment section 91 judges that all of Conditions 1 to 4 are satisfied, the sequence control section 90 makes a change of sequences for performing double-side image formation on plural sets of sheets of paper in succession and thereby changes, in the after-mentioned manner, the timing of feeding and conveyance of sheets of paper and the order in which images are formed, so as to make it possible to perform image formation on the next set while performing a post-process on the previous set.

Although detailed later, the sequence control section 90 changes from a normal sequence to a first sequence or a second sequence. The normal sequence is a sequence for: normally feeding two sheets of paper at a time in succession, regardless of difference in set of sheets of paper; after sequentially forming images on the respective first surfaces of the two sheets of paper thus fed, sequentially forming images on the respective second surfaces of the two sheets of paper and outputting the two sheets of paper to the post-processing apparatus 3 in succession; and feeding the next two sheets of paper in succession.

The first sequence is a sequence for: normally feeding two sheets of paper at a time in succession until the last sheet of paper of a set of sheets of paper is detected; after sequentially forming images on the respective first sides of the two sheets of paper thus fed, sequentially forming images on the respective second sides of the two sheets of paper and outputting the two sheets of paper to the post-processing apparatus 3 in succession; normally feeding the next two sheets of paper in succession; normally feeding only the last sheet of paper of the set of sheets of paper; immediately after forming an image on a first side of the sheet of paper thus fed, forming an image on a second side of the sheet of paper and outputting only the sheet of paper to the post-processing apparatus 3.

According to the first sequence, a period of time during which an image is formed on a first side of each of the first and second sheets of paper of the next set can be spent on a post-process for the previous set as in the case where the number of sheets of paper that constitute a single set is an even number.

Further, the second sequence is a sequence for: normally feeding only the first sheet of paper of a set of sheets of paper; immediately after forming an image on a first side of the sheet of paper thus fed, forming an image on a second side of the sheet of paper and outputting only the sheet of paper to the post-processing apparatus 3; subsequently feeding two sheets of paper at a time in succession until the first sheet of paper of the next set is detected; after sequentially forming images on the respective first sides of the two sheets of paper thus fed, sequentially forming images on the respective second sides of the two sheets of paper and outputting the two sheets of paper to the post-processing apparatus 3 in succession; and normally feeding the next two sheets of paper in succession.

According to the second sequence, the first sheet of paper of a set of sheets of paper is necessarily fed alone, has images formed on both sides thereof, and then is outputted to the post-processing apparatus 3. Therefore, a period of time during which an image is formed on a first side of the first sheet of paper and the after-mentioned lost time B, which results form the formation of images on both sides of a sheet of paper fed and conveyed alone, can be spent on a post-process for the previous set.

The merit judgment section (merit judgment means) 92 determines the existence of a merit by making a comparison between (i) a value 2B obtained by doubling the lost time B, which is a difference between the amount of time required to form an image on one side of each sheet of paper and the amount of time required to feed and convey only a single sheet of paper, form images on both sides of the sheet of paper, and output the sheet of paper alone, and (ii) the amount of post-processing time M required to perform a post-process on a single set.

The sequence control section 90 changes from the normal sequence to the first or second sequence only in cases where the merit judgment section 92 judges that there is a merit.

It should be noted here that the sequence control section 90 includes a timing adjustment section (timing adjustment means) 93 for adjusting the timing of feeding and conveyance and an order adjustment section (order adjustment means) 94 for adjusting the order in which images are formed.

When it is judged that it is necessary to change to the first or second sequence, the timing adjustment section 93 adjusts the timing of feeding and conveyance of sheets of paper so that the sheets of paper are fed and conveyed according to the first or second sequence, and controls the operation of the load device 59.

When it is judged that it is necessary to change to the first or second sequence, the order adjustment section 94 adjusts the order of images so that the images are formed according to the first or second sequence, and controls the operation of the load device 58.

Figure 6:
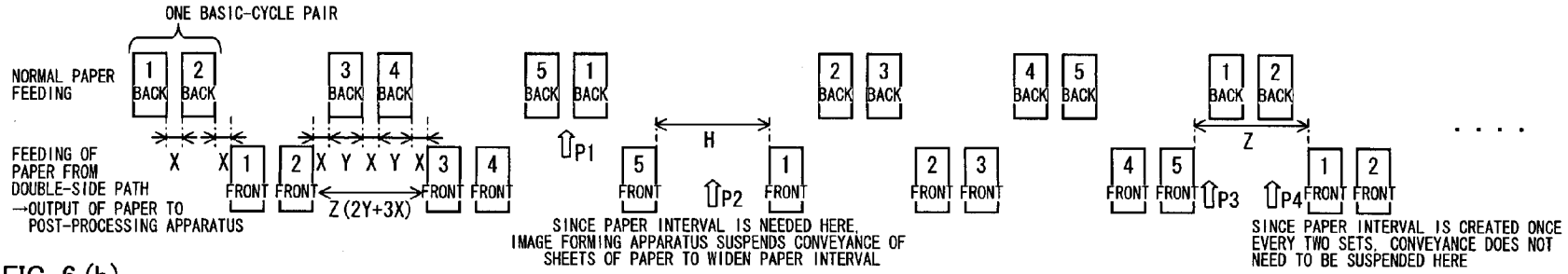
FIGS. 6(*a*) through 6(*d*) are timing charts showing schedules of image formation in the image forming system.
Figure 6:
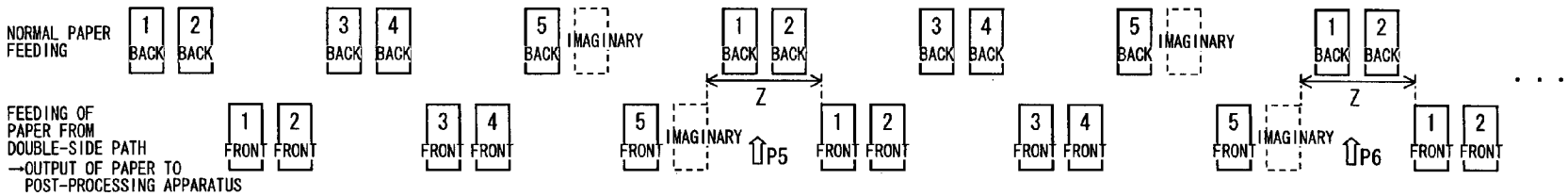
Figure 6:
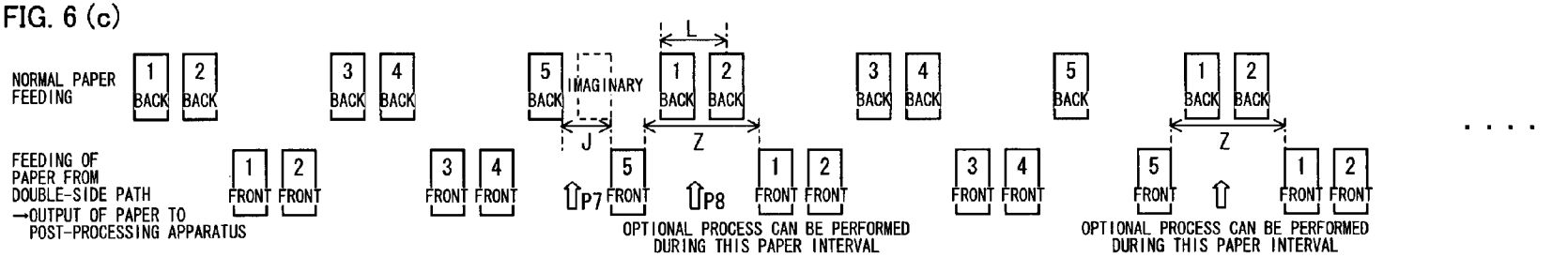
Figure 6:
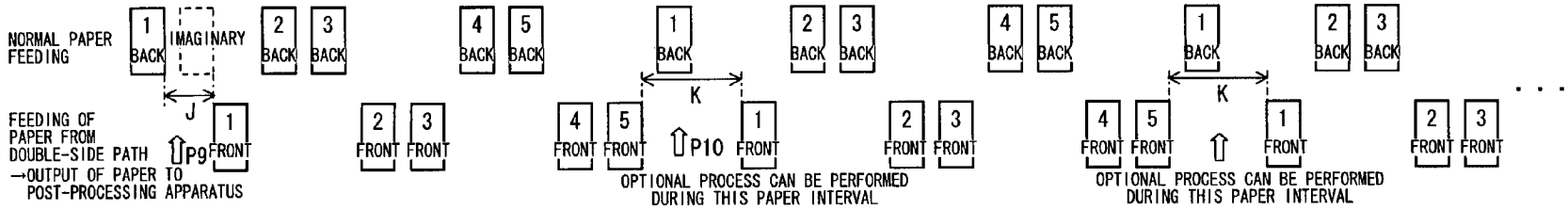

With reference to FIGS. 6(*a*) through 6(*d*), the following describes a schedule of image formation according to the normal sequence and schedules of image formation according to the first and second sequences after change in sequence.

FIGS. 6(*a*) through 6(*d*) show four types of schedule of image formation that is performed in cases where the image forming system 1 according to the present embodiment performs two or more jobs of forming images on both sides of each of five sheets of A4 paper (copying of five double-sided documents or double-side copying of ten single-sided documents). Each of the sheets of paper is conveyed transversely in a conveying direction parallel to the shorter sides thereof.

In each of FIGS. 6(*a*) through 6(*d*), the horizontal axis represents passage of time. Further, the upper row represents normal paper feeding by which sheets of paper are fed from the paper storage section 7 of the image forming apparatus 2 or the paper feeding apparatus 4 or 5 (i.e., the second paper conveying path 35, the fourth paper conveying path 37, or the fifth paper conveying path 38). On the other hand, the lower row represents paper feeding by which sheets of paper are fed from the third paper conveying path (sub-conveying path, double-side path) 36, which is used at the time of double-side image formation. The sheets of paper are outputted to the post-processing apparatus 3 at the timing of the lower row.

Further, each of the quadrangles □ represents a sheet of A4 paper to be conveyed transversely, and a space between quadrangles □ and □ represents a paper interval, i.e., a distance between sheets of paper. Moreover, the numbers enclosed in the quadrangles □ represent the order of documents, and each of the words "FRONT" and "BACK" enclosed in the quadrangles □ indicates whether the front-side or back-side image of a double-sided document is formed on the sheet of paper.

First, FIG. 6(*a*) shows a schedule of image formation according to the normal sequence. According to this, the first and second sheets of paper are normally fed in succession as a basic-cycle pair. On the first sheet of paper, the back-side image of the first document is formed when the first sheet of paper passes through the image forming position 30 for the first time. Then, on the second sheet of paper, the back-side image of the second document is formed when the second sheet of paper passes through the image forming position 30 for the first time.

It should be noted here that the second sheet of paper is conveyed after the first sheet of paper with a predetermined distance X therebetween. (To be precise, since the horizontal axis represents passage of time, the predetermined distance X represents passage of time corresponding thereto.) The distance between sheets of paper is referred to as "paper interval", which is determined by a period of time between a point of time where the back end of the first sheet of paper leaves the registration roller 32 and a point of time where the registration roller 32 allows passage of the head of the second sheet of paper (resumes conveyance).

The present image forming apparatus 2 is capable of forming an image on one side of each of 110 sheets of A4 paper in transverse conveyance and outputting the sheets of paper per minute, for example. In that case, the paper interval is X. Each of FIGS. 6(*a*) through 6(*d*) shows a state where the image forming apparatus 2 is driven to double-side image formation with the same 100% performance as single-side image formation, which forms an image on one side of each of 110 sheets of A4 paper in transverse conveyance and outputs the sheets of paper per minute. In the case where the paper interval is X, the registration roller 32 only instantaneously suspends the conveyance of sheets of paper.

According to the schedule shown in FIG. 6(*a*), while the second sheet of paper is passing through the image forming position 30 for the first time, the first sheet of paper is sent to the third paper conveying path 36, fed from the third paper conveying path 36, then reconveyed to the image forming position 30 via the registration roller 32 after the second sheet of paper with a paper interval X therebetween. Then, the front-side image of the first document is formed on the first sheet of paper when the first sheet of paper passes through the image forming position 30 for the second time, and then the first sheet of paper is outputted to the post-processing apparatus 3.

As with the first sheet of paper, the second sheet of paper is fed again via the third paper conveying path 36, reconveyed to the image forming position 30 with a paper interval X between the first and second sheets of paper, and then outputted to the post-processing apparatus 3 after the front-side image of the second document is formed on the second sheet of paper. It should be noted here that the first and second sheets of paper are outputted in succession with a paper interval X therebetween. Further, since a front-side image is formed after a back-side image is formed, sheets of paper are sequentially stacked with the front-side image facing down, even in a face-down paper output manner.

Meanwhile, while the second sheet of paper is passing through the image forming position 30 for the second time, the third sheet of paper, which makes a next basic-cycle pair with the fourth sheet of paper, is normally fed, and then conveyed after the second sheet of paper with a paper interval X therebetween. On the third sheet of paper, the back-side image of the third document is formed when the third sheet of paper passes through the image forming position 30 for the first time.

Then, while the third sheet of paper is passing through the image forming position 30, the fourth sheet of paper is also normally fed, and then conveyed after the third sheet of paper with a paper interval X therebetween.

On the fourth sheet of paper, the back-side image of the fourth document is formed when the fourth sheet of paper passes through the image forming position 30 for the first time.

While the fourth sheet of paper is passing through the image forming position 30 for the first time, the third sheet of paper is conveyed to the third paper conveying path 36, fed again, and then conveyed after the fourth sheet of paper. After that, the front-side image of the fourth document is formed on the fourth sheet of paper when the fourth sheet of paper passes through the image forming position 30 for the second time, and then the fourth sheet of paper is outputted to the post-processing apparatus 3. It should be noted here that the paper interval between the third and second sheets of paper equals to a distance Z. The distance Z is obtained by adding three paper intervals X to a distance corresponding to the size Y of the two sheets of paper in the conveying direction.

It should be noted that the subsequent movements of the third and fourth sheets of paper are the same as in the case where the first and second sheets of paper are fed from the third paper conveying path 36.

Moreover, in cases where the number of sheets of paper that constitute a single set is an odd number, the last sheet of paper of the first set, i.e., the fifth sheet of paper of the first set makes a basic-cycle pair with the first sheet of paper of the second set. That is, after the fifth sheet of paper of the first set is normally fed, the first sheet of paper of the second set is normally fed after the fifth sheet of paper of the first set with a paper interval X therebetween (see P1).

On the fifth sheet of paper of the first set, the back-side image of the fifth document is formed while the fifth sheet of paper of the first set is passing through the image forming position 30 for the first time. While the first sheet of paper of the second set is passing through the image forming position 30, the fifth sheet of paper of the first set is sent to the third paper conveying path 36 and then fed again. Then, after the first sheet of paper of the second set passes through the image forming position 30, the fifth sheet of paper of the first set is reconveyed to the image forming position 30 with a paper interval X therebetween. The front-side image of the fifth document is formed on the fifth sheet of paper of the first set when the fifth sheet of paper of the first set passes through the image forming position 30 for the second time, and then the fifth sheet of paper of the first set is outputted to the post-processing apparatus 3.

When the fifth sheet of paper of the first set, i.e., the last sheet of paper of the first set is outputted to the post-processing apparatus 3, the post-processing apparatus 3 performs a post-process on these five sheets of paper (see P2). While the post-processing apparatus 3 is performing the post-process on the first set, the first sheet of paper, on which the back-side image of the first document has been formed, of the second set is sent to the third paper conveying path 36, and then suspended until completion of the post-process for the first set.

Such a suspension of sheets of paper is performed by the registration roller 32. The registration roller 32 resumes the conveyance of the first sheet of paper of the second set, for example, at such timing that the first sheet of paper of the second set is outputted to the post-processing apparatus 3 at a point of time where the post-processing apparatus 3 has finished the post-process for the first set and become ready to accept the second set of sheets of paper.

The schedule shown in FIG. 6(*a*) shows an example where the paper interval H, which is required for a post-process, is the same distance as the aforementioned paper interval Z, which corresponds to the amount of time required to form images on two sheets of paper.

On the first sheet of paper of the second set, the front-side image of the first document is formed when the resumption of conveyance causes the first sheet of paper of the second set to pass through the image forming position 30 for the second time. After that, the first sheet of paper of the second set is outputted to the post-processing apparatus 3.

Further, after the first sheet of paper, the second and third sheets of paper, which make a basic-cycle pair with each other, are normally fed in succession with a paper interval X therebetween. It should be noted that the pair of the second and third sheets of paper and the pair of the fourth and fifth sheets of paper move in the same manner as the pair of the first and second sheets of paper of the first set.

Moreover, even if the number of sheets of paper that constitute a single set is an odd number, the fifth sheet of paper of the second set, i.e., the last sheet of paper of the second set makes a pair with the fourth sheet of paper of the second set. As a corollary, the second and third sets are placed with the aforementioned paper interval Z therebetween, which corresponds to a period of time between a point of time where the second sheet of paper of the previous pair is outputted and a point of time where the first sheet of paper of the next pair is outputted (see P3). This makes it possible to perform a post-process on the second set with use of the paper interval Z. Therefore, the image forming apparatus 2 goes on to start image formation of the third set (see P4).

Although not assumed in FIG. 6(*a*), in cases where the amount of post-processing time is larger than the amount of time required to output two sheets of paper (i.e., the amount of time required to form an image on one side of each of two sheets of paper), which corresponds an paper interval Z, it is necessary to further increase the paper interval by delaying the timing of normal feeding of the first sheet of paper of the third set by the amount of time that exceeds the amount of time required to form an image on one side of each of two sheets of paper.

Thus, in subjecting plural sets to double-side image formation jobs that require post-processes, the normal sequence makes it possible that in cases where the number of sheets of paper that constitute a single set is an odd number, a period of time during which images are formed on both sides of each of the first and second sheets of paper of the next set (or, in real terms, the amount of time required to form an image on one side of each of two sheets of paper) is spent on a post-process once every two sets, as with the second and third sets. However, it is necessary to suspend the conveyance of sheets of paper at least once every two sets, as with the first and second sets, in order to allow time for post-processing. Therefore, in cases where the image forming system 1 is constituted by equipping the image forming apparatus 2 with the post-processing apparatus 3, the image forming apparatus 2 cannot perform to the best of its potential, thus decreasing in productivity.

Also in subjecting plural sets to double-side image formation jobs that require post-processes, it is possible that in cases where the number of sheets of paper that constitute a single set is an even number, a period of time during which an image is formed on a first side of each of the first and second sheets of paper of the next set is necessarily spent on a post-process. Therefore, the image forming system 1 does not waste the potential of the image forming apparatus 2, provided the amount of post-processing time is not larger than the amount of time required to form an image on one side of each of two sheets of paper.

The inventor of the present invention diligently studied to increase the productivity of such an image forming system 1 that, in cases where the number of sheets of paper that constitute a single set is an odd number, subjects plural sets to double-side image formation jobs that require post-processes. In the result, the inventor devised three types of schedule of image formation as shown in FIGS. 6(*b*) through 6(*d*).

FIG. 6(*b*) shows the first schedule that the inventor devised. According to this, the number of sheets of paper that constitute the first set is made to be an even number by placing an imaginary sheet of paper behind the fifth sheet of paper of the first set. The phrase "placing an imaginary sheet of paper" here means that the timing of feeding and conveyance of sheets of paper and the order in which images are formed are controlled as if there existed a sheet of paper and images were formed on both sides of the sheet of paper, although the imaginary sheet of paper is neither fed nor subjected to image formation.

With this, the fifth sheet of paper makes a pair with the imaginary sheet of paper, and then is conveyed through such a path that images are formed on both sides of the fifth sheet of paper. That is, the schedule is the same as in the case where plural sets of six sheets of paper are subjected to double-side image formation jobs.

Indeed, this makes it possible that by performing a process as if there were an even number of documents, a period of time during which images are formed on both sides of each of the first and second sheets of paper of the next set can be necessarily spent on a post-process (see P5 and P6).

However, in this case, as evidenced by a comparison between the timing of normal feeding of the first sheet of paper of the third set and the timing of normal feeding of the first sheet of paper of the third set of FIG. 6(*a*), the start of image formation of the third set is delayed by the amount of time required to form images on one side of each of two sheets of paper. This is because placing the imaginary sheet of paper causes an increase in amount of time required for image formation per set.

FIG. 6(*c*) shows a schedule, intended to remedy such a problem with the schedule of FIG. 6(*b*) that the placement of an imaginary sheet of paper causes an increase in amount of processing time, which conforms to the first sequence.

According to this, first, because of an imaginary sheet of paper, attention was paid to the fact that in conveying the fifth sheet of paper fed from the third paper conveying path 36, it is not necessary to consider the size Y of the imaginary sheet of paper in the conveying direction and a paper interval X between the imaginary sheet of paper and the fifth sheet of paper having passed through the image forming position 30 for the first time.

In view of this, the fifth sheet of paper having passed through the image forming position 30 for the first time is returned via the third paper conveying path 36 if at all possible, and then reconveyed to the image forming position 30 by feeding it from the third paper conveying path 36 as quickly as possible (see P7).

In FIG. 6(*c*), the amount of time required to convey the fifth sheet of paper alone through such a path that images are formed on both sides of the fifth sheet of paper can be shortened by the amount of time corresponding to a paper interval X, in comparison with the schedule shown in FIG. 6(*b*). The difference between the back end of the fifth sheet of paper passing through the image forming position 30 for the first time and the head of the fifth sheet of paper passing through the image forming position 30 for the second time is a paper interval J.

Furthermore, because of the imaginary sheet of paper, attention was paid to the fact that in normally feeding the first sheet of paper of the second set, it is not necessary to consider the size Y of the imaginary sheet of paper in the conveying direction and a paper interval X between the imaginary sheet of paper and the fifth sheet of paper passing through the image forming position 30 for the second time.

In view of this, it should be further noted here that the first sheet of paper, which is normally fed, of the second set is conveyed after the fifth sheet of paper with a paper interval X therebetween (see P8). With this, the timing of feeding of the first sheet of paper of the second set can be put ahead by the amount of time corresponding to a distance L. The distance L is obtained by adding two paper intervals X to a distance corresponding to the size Y of the imaginary sheet of paper in the conveying direction.

That is, according to the schedule shown in FIG. 6(*c*), while a period of time during which images are formed on both sides of each of the first and second sheets of paper can be necessarily spent on a post-process, as with the schedule shown in FIG. 6(*b*), the amount of time required for image formation per set can be shortened in total by the amount of time corresponding to the distance X+L, in comparison with the schedule shown in FIG. 6(*b*).

Meanwhile, as with FIG. 6(*c*), FIG. 6(*d*) also shows a schedule, intended to remedy such a problem with the schedule of FIG. 6(*b*) that the placement of an imaginary sheet of paper causes an increase in amount of processing time, which conforms to the second sequence. In FIG. 6(*d*), an imaginary sheet of paper is placed behind the first sheet of paper, and then attention is paid to the imaginary sheet of paper, as with FIG. 6(*c*), so that the first sheet of paper having passed through the image forming position 30 is returned via the third paper conveying path 36 if at all possible and then reconveyed to the image forming position 30 by feeding it from the third paper conveying path 36 as quickly as possible (see P9).

According to the schedule shown in FIG. 6(*d*), while a period of time during which images are formed on both sides of each of the first and second sheets of paper can be necessarily spent on a post-process, as with the schedule shown in FIG. 6(*c*), the amount of time required for image formation per set can be shortened in total by the amount of time corresponding to the distance X+L, in comparison with a schedule set by simply placing an imaginary sheet of paper behind the first sheet of paper.

However, since the schedule shown in FIG. 6(*d*) normally feeds the first sheet of paper alone, forms images on both sides of the first sheet of paper, and then outputs the first sheet of paper, the amount of time that can be used for a post-process becomes shorter than the amount of time required to normally feed the first and second sheets of paper and form an image on one side of each of the first and second sheets of paper.

It should be noted here that even such a change of sequences may result in lower productivity on the contrary in the case of a short post-processing time. That is, for each set of sheets of paper, the sequence after change necessarily feeds and conveys a single sheet of paper alone, forms images on both sides of the sheet of paper, and then outputs the sheet of paper. Therefore, each set of sheets of paper incurs lost time B, i.e., a difference between the amount of time required to form an image on one side of each sheet of paper and the amount of time required to feed and convey a sheet of paper alone, form images on both sides of the sheet of paper, and output the sheet of paper.

Figure 7:
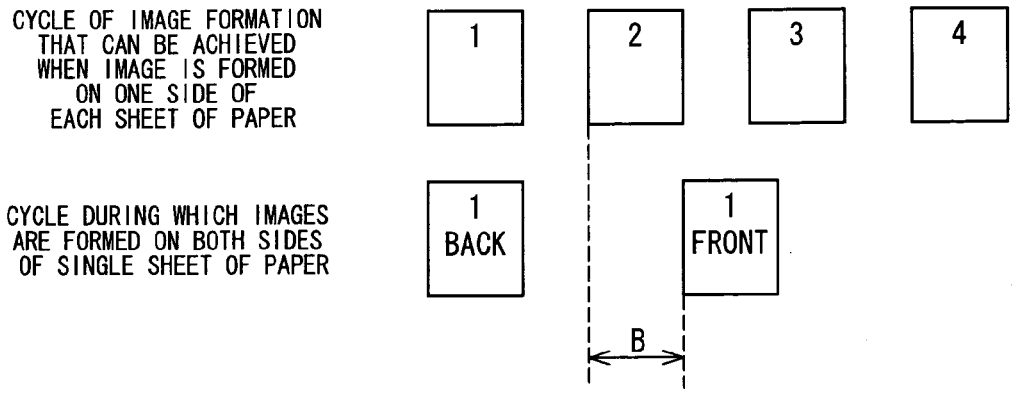
FIG. 7 shows lost time incurred by forming images on both sides of a single sheet of paper in cases where double-side image formation can be achieved with 100% performance, the upper row of FIG. 7 showing a cycle of single-side image formation that can be achieved with 100% performance at paper intervals X, the lower row of FIG. 7 showing a cycle during which images are formed on both sides of a single sheet of paper.

FIG. 7 shows such lost time B. In FIG. 7, the upper row shows a cycle of single-side image formation that can be achieved with 100% performance at paper intervals X. This cycle is identical to a cycle of double-side image formation that can be achieved with 100% performance at the same paper intervals X as single-side image formation. The lower row shows a cycle during which images are formed on both sides of a single sheet of paper. Even in cases where double-side image formation can be achieved with 100% performance, lost time B is necessarily incurred. In the example shown in FIG. 7, the lost time B incurred corresponds to the size Y of a single sheet of paper in the conveying direction.

As mentioned above, even when the number of sheets of paper that constitute a single set of double-side image formation is an odd number, a period of time during which an image is formed on a first side of each of the first and second sheet of paper of the next set can be necessarily spent on a post-process once every two sets, as in the case where the number of sheets of paper is an even number. Therefore, it is once every two sets that image formation is suspended for the purpose of allowing time for post-processing.

Therefore, in cases where the amount of post-processing time M is larger than a value 2B obtained by doubling the lost time B incurred by each set of sheets of paper, the merit of time reduction is brought about by feeding and conveying a single sheet of paper alone, forming images on both sides of the sheet of paper, and then outputting the sheet of paper. On the other hand, in cases where the amount of post-processing time M is smaller than the value 2B, the amount of time required for each set becomes larger than in cases where no change of sequences is made. This causes decline in productivity.

Accordingly, in the present embodiment, the aforementioned merit judgment section 92 makes a comparison between (i) a value 2B obtained by doubling the lost time B, which is a difference between the amount of time required to form an image on one side of each sheet of paper and the amount of time required to feed and convey only a single sheet of paper, form images on both sides of the sheet of paper, and output the sheet of paper alone, and (ii) the amount of post-processing time M required to perform a post-process on a single set. Then, in cases where the amount of post-processing time M is larger than the value 2B, the merit judgment section 92 judges that there is a merit in making a change of sequences for image formation, and the sequence control section 90 makes a change of sequences.

Figure 8:
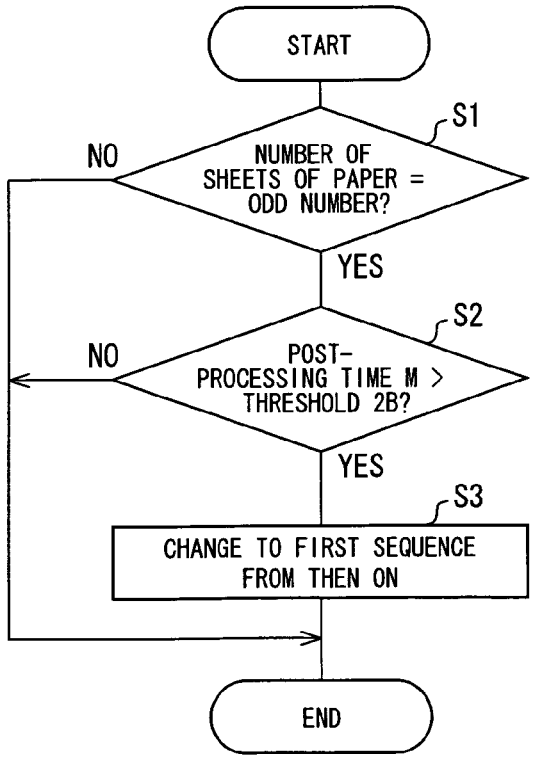
FIG. 8 shows a control flow for making a change of sequences for image formation in the image forming system.
Figure 9:
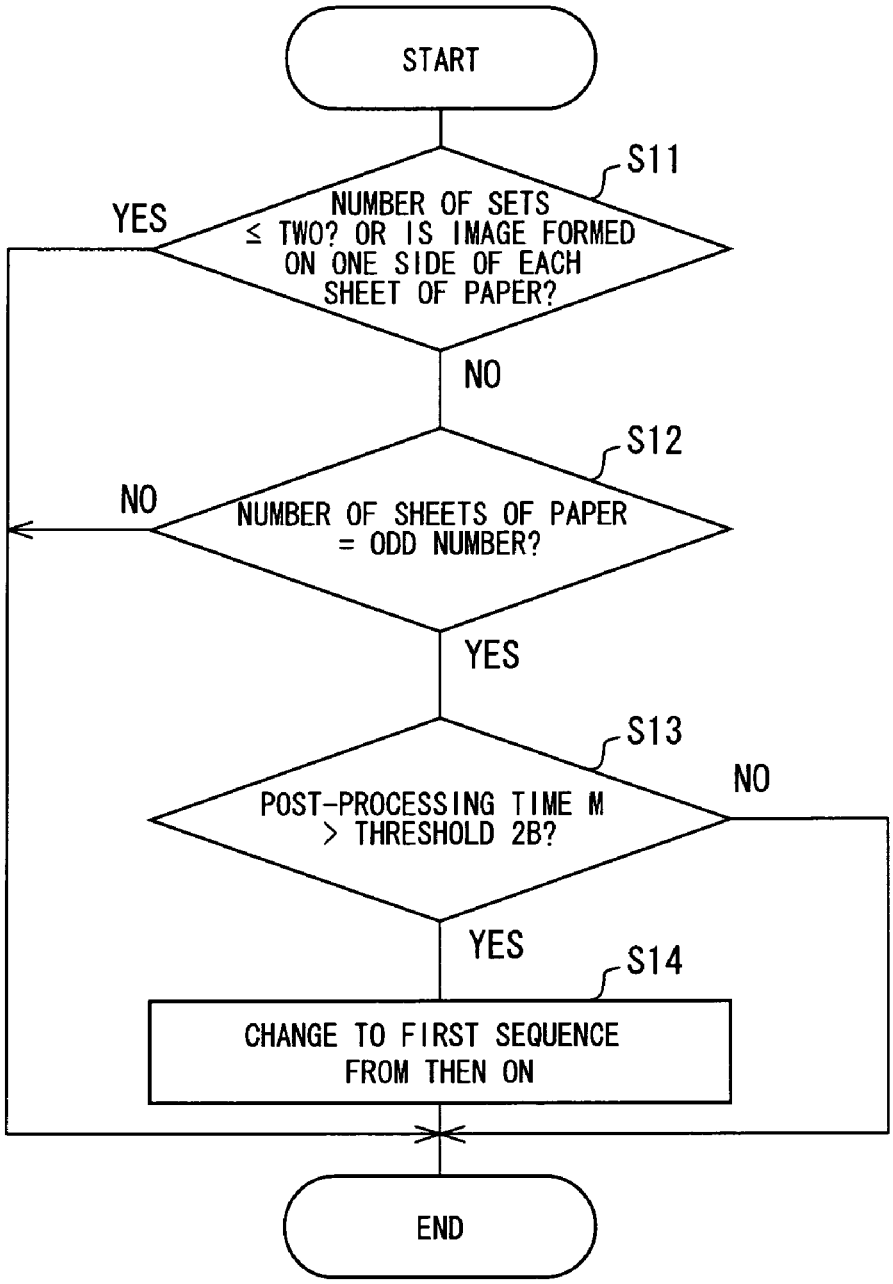
FIG. 9 shows another control flow for making a change of sequences for image formation in the image forming system.

FIGS. 8 and 9 each show a control flow by which the sequence control section 90 makes a change of sequences. Among them, FIG. 8 shows a case where it is possible to judge from the first set on completion of scanning of document images whether images are formed on an odd number of sheets of paper.

In cases where either the amount of post-processing time M is acquired from the post-processing apparatus 3 or the amount of post-processing time M is managed in the PCU 52 after the completion of scanning of document images, the flow is started once the amount of post-processing time M is determined. The flow is performed in the case of double-side image formation.

First, it is judged whether or not the number of sheets of paper that constitute a single set is an odd number (S1). In cases where the number is an even number, it is not necessary to change the sequence. Therefore, the flow is finished.

On the other hand, when it is judged in S1 that the number is an odd number, the flow proceeds to S2, where it is judged whether the amount of post-processing time M is larger than a threshold 2B obtained by doubling the lost time B. When it is judged that the amount of post-processing time M is larger than the threshold 2B, the flow proceeds to S3. Subsequently, the sequence is changed to the first sequence for, in the case of the last sheet of paper of a set of sheets of paper, feeding and conveying the sheet of paper alone, forming images on both sides of the sheet of paper, and outputting the sheet of paper alone, as shown in the schedule of FIG. 6(*c*). Thus, the flow is finished.

In S3, the sequence may be changed to the second sequence for, in the case of the first sheet of paper of a set of sheets of paper, feeding and conveying the sheet of paper alone, forming images on both sides of the sheet of paper, and outputting the sheet of, paper alone, whose schedule is shown in FIG. 6(*d*).

Meanwhile, according to FIG. 9, in the case of a model that starts image formation while scanning document images, the need for changing the sequence cannot be determined, because the scanning of document images is not completed during image formation of the first set.

In cases where either the amount of post-processing time M is acquired from the post-processing apparatus 3 the amount of post-processing time M is managed in the PCU 52 after the completion of scanning of document images during the image formation of the first set, the flow is started once the amount of post-processing time M is determined.

First, in cases where the first set is started after completion of scanning of document images, it is judged whether the number of sets is not more than two or whether an image is formed on one side of a sheet of paper (S11). The reason why it is judged here whether the number of sets is not more than two is as follows: In cases where the number of sets is two, only one set is subjected to image formation after it is determined that the number of sheets of paper is an odd number; therefore, there is no room for improvement of efficiency even if the sequence is changed.

When it is judged in S11 that the number of sets is greater than two, it is judged whether or not the number of sheets of paper that constitute each set is an odd number (S12). In cases where the number is an even number, it is not necessary to change the sequence. Therefore, the flow is finished.

On the other hand, when it is judged in S12 that the number is an odd number, the flow proceeds to S13, where it is judged whether the amount of post-processing time M is larger than a threshold 2B obtained by doubling the lost time B. When it is judged that the amount of post-processing time M is larger than the threshold 2B, the flow proceeds to S14. Subsequently, the sequence is changed to the first sequence for, in the case of the last sheet of paper of a set of sheets of paper, feeding and conveying the sheet of paper alone, forming images on both sides of the sheet of paper, and outputting the sheet of paper alone, whose schedule is shown FIG. 6(*c*). Thus, the flow is finished.

In S14, as in S3, the sequence may be changed to the second sequence for, in the case of the first sheet of paper of a set of sheets of paper, feeding and conveying the sheet of paper alone, forming images on both sides of the sheet of paper, and outputting the sheet of paper alone, whose schedule is shown FIG. 6(*d*).

As described above, in the image forming system 1 according to the present embodiment, the conditional judgment section 91 judges whether conditions for image formation are as follows: (1) double-side image formation is performed, i.e., images are formed on both sides of a sheet of paper; (2) the number of sheets of paper that constitute a single set is an odd number; (3) the number of sets is not less than two; (4) it is necessary to delay image formation of the next set in order to perform a post-process on the previous set outputted ahead. When the conditional judgment section 91 judges that double-side image formation is performed, that the number of sheets of paper of a single set is an odd number, that the number of sets is not less than two, and that it is necessary to delay image formation of the next set, the sequence control section 90 makes a change of sequences for performing double-side image formation on plural sets of sheets of paper in succession, so as to make it possible to perform image formation on the next set while performing a post-process on the previous set.

This makes it possible not to delay image formation of the next set (image formation job) in order to allow post-processing time for the previous set (image formation job), or to minimize the duration of a delay, if any. An image forming system constituted by such an image forming apparatus does not waste the performance of the image forming apparatus, thus enabling improvement in productivity.

Embodiment 2

Another embodiment of the present invention will be described below with reference to FIGS. 10 through 14. For convenience of explanation, members having the same functions as those used in Embodiment 1 are given the same reference numerals, and as such, will not be described below.

An image forming system 100 according to the present embodiment differs from the image forming system 1 according to the aforementioned embodiment in that the image forming system 100 has an image forming apparatus 101 to be equipped with the post-processing apparatus 3. The image forming apparatus 101 differs from the image forming apparatus 2 mainly in sequence for double-side image formation due to differences in length of a first paper conveying path 31' and a third paper conveying path 36'. However, the image forming apparatus 101 is substantially identical in structure to the image forming apparatus 2.

Figure 11:
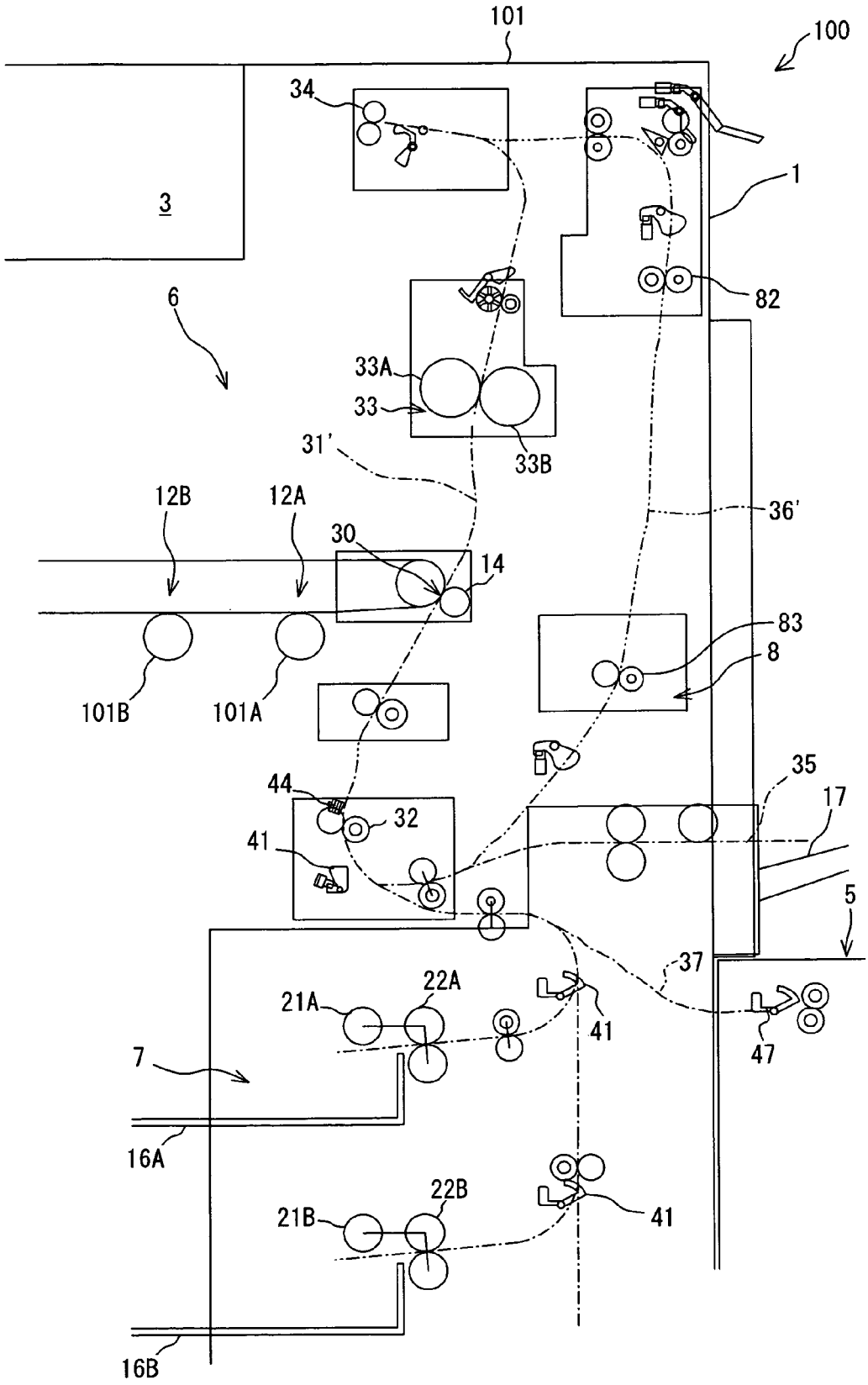
FIG. 11 shows an arrangement of a conveying path of a paper conveying section of an image forming apparatus of the image forming system.

FIG. 11 shows an arrangement of a main part of the paper conveying section 8 of the image forming apparatus 101 in the vicinity of the first paper conveying path 31'. A comparison between FIG. 4 and FIG. 11 shows that the first and third paper conveying paths 31' and 36' of the image forming apparatus 101 are longer than those of the image forming apparatus 2. At the time of double-side image formation, it is possible to convey a total of three sheets of paper simultaneously to the first and third paper conveying paths 31' and 36'. It should be noted that the total number of sheets of paper that can be conveyed to the first and third paper conveying paths 31 and 36 of the image forming apparatus 2 is two.

The following describes an arrangement of the present image forming system 100 to which attention should be paid, i.e., a sequence change in image formation that is made at the time of double-side image formation which requires a post-process. As in the image forming system 1, a sequence change in image formation requires the satisfaction of all the following conditions: (1) double-side image formation is performed; (2) the number of sheets of paper that constitute a single set is an odd number; (3) the number of sets is not less than two; and (4) it is necessary to delay image formation of the next set for a post-process for the previous set. The present system, which can retain three sheets of paper, further requires the satisfaction of a condition in which the number of sheets of paper that constitute a single set is an odd number of not less than five.

Figure 10:
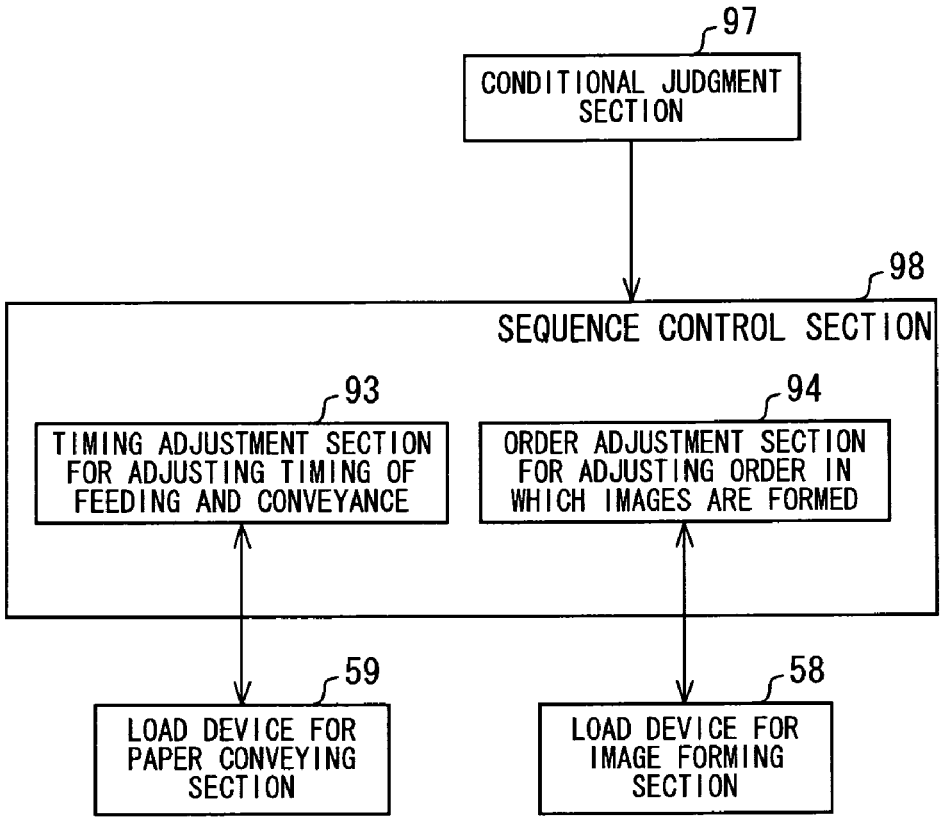
FIG. 10 is a functional block diagram that makes a change of sequences for image formation in an image forming system according to another embodiment of the present invention.

FIG. 10 shows a functional block diagram of a control section that realizes a change of sequences for image formation in an image forming system 100 according to the present embodiment. Included are a sequence control section (sequence control means) 98 and a conditional judgment section (conditional judgment means) 97. These components are constituted by the PCU 52 and the ICU 51 that are shown in FIG. 5 in Embodiment 1.

The conditional judgment section 97 judges, from information indicative of conditions for image formation, whether or not all the following four conditions for image formation are satisfied:

Condition 1: Double-side image formation is performed, i.e., images are formed on both sides of a sheet of paper.

Condition 2: The number of sheets of paper that constitute a single set is an odd number of not less than five.

Condition 3: The number of sets is not less than two.

Condition 4: It is necessary to delay image formation of the next set in order to perform a post-process on the set outputted ahead.

When the conditional judgment section 97 judges that all of Conditions 1 to 4 are satisfied, the sequence control section 98 makes change of sequences for performing double-side image formation on plural sets of sheets of paper in succession and thereby changes the timing of feeding and conveyance of sheets of paper and the order in which images are formed, so as to make it possible to perform image formation on the next set while performing a post-process on the previous set.

Although detailed later, the sequence control section 98 changes from a normal sequence to a third sequence or a fourth sequence. The normal sequence is a sequence for: normally feeding only the first three sheets of paper of the first set in succession; sequentially forming images on the respective first sides of the three sheets of paper thus fed; sequentially forming images on the respective second sides of the first and second sheets of paper and outputting them to the post-processing apparatus 3 in succession, while keeping the third sheet of paper waiting in the third paper conveying path 36'; normally feeding two sheets of paper at a time in succession regardless of difference in set of sheets of paper, starting from the second normal paper feeding; sequentially forming images on the respective first sides of the two sheets of paper thus fed; conveying the first one of the two sheets of paper in succession to the third sheet of paper kept waiting, sequentially forming images on the respective second sides thereof, and outputting them to the post-processing apparatus 3 in succession, while keeping the second one of the two sheets of paper waiting in the third paper conveying path 36'; and normally feeding the next two sheets of paper in succession.

The third sequence is a sequence for: normally feeding only the first three sheets of paper of the first set in succession; sequentially forming images on the respective first sides of the three sheets of paper thus fed; sequentially forming images on the respective second sides of the first and second sheets of paper and outputting them to the post-processing apparatus 3 in succession, while keeping the third sheet of paper waiting in the third paper conveying path 36'; normally feeding two sheets of paper at a time in succession from the second normal paper feeding; sequentially forming images on the respective first sides of the two sheets of paper thus fed; conveying the first one of the two sheets of paper in succession to the third sheet of paper kept waiting, sequentially forming images on the respective second sides thereof, and outputting them to the post-processing apparatus 3 in succession, while keeping the second one of the two sheets of paper waiting in the third paper conveying path 36'; normally feeding the next two sheets of paper; sequentially forming images on the respective first sides of the two sheets of paper thus fed, upon finishing normally feeding the last sheet of paper; conveying the first one of the two sheets of paper in succession to the second sheet of paper kept waiting in the third paper conveying path 36', sequentially forming images on the respective second sides thereof, and outputting them to the post-processing apparatus 3 in succession, while keeping the last sheet of paper, i.e., the second one of the next two sheets of paper waiting in the third paper conveying path 36'; normally feeding only one sheet of paper then; forming an image on a first side of the sheet of paper thus fed and then keeping the sheet of paper waiting in the third paper conveying path 36'; conveying only the last sheet of paper, which have been kept waiting, of the first set, forming an image on a second side of the last sheet of paper, and outputting only the last sheet of paper to the post-processing apparatus 3; and normally feeding two sheets of paper at a time in succession again from then on.

According to such a third sequence, a period of time during which an image is formed on a first side of each of the second and third sheets of paper of the next set can be spent on a post-process for the previous set.

Further, the fourth sequence is a sequence for: normally feeding only the first three sheets of paper of each set in succession; sequentially forming images on the respective first sides of the three sheets of paper thus fed; sequentially forming images on the respective second sides of the first and second sheet of paper and outputting them to the post-processing apparatus 3 in succession, while keeping the third sheet of paper waiting in the third paper conveying path 36'; normally feeding two sheets of paper at a time in succession from the second normal paper feeding; sequentially forming images on the respective first sides of the two sheets of paper thus fed; conveying the first one of the two sheets of paper in succession to the third sheet of paper kept waiting, sequentially forming images on the respective second sides thereof, and outputting them to the post-processing apparatus 3 in succession, while keeping the second one of the two sheets of paper waiting in the third paper conveying path 36'; normally feeding the next two sheets of paper; sequentially forming images on the respective first sides of the two sheets of paper thus fed, upon finishing normally feeding the last sheet of paper of the set; and conveying the first and second sheets of paper in succession to the sheet of paper kept waiting in the sub-conveying path, sequentially forming images on the respective second sides of the three sheets of paper, and outputting them to the post-processing apparatus 3 in succession, without keeping the last sheet of paper, i.e., the second sheets of paper waiting in the third paper conveying path 36'.

According to such a fourth sequence, a period of time during which an image is formed on a first side of each of the first, second, and third sheets of paper of the next set can be spent on a post-process for the previous set.

Also in the present embodiment, the sequence control section 98 includes a timing adjustment section (timing adjustment means) 93 for adjusting the timing of feeding and conveyance and an order adjustment section (order adjustment means) 94 for adjusting the order in which images are formed.

When it is judged that it is necessary to change to the third or fourth sequence, the timing adjustment section 93 adjusts the timing of feeding and conveyance of sheets of paper so that the sheets of paper are fed and conveyed according to the third or fourth sequence, and controls the operation of the load device 59.

When it is judged that it is necessary to change to the third or fourth sequence, the order adjustment section 94 adjusts the order of images so that the images are formed according to the third or fourth sequence, and controls the operation of the load device 58.

Figure 12:
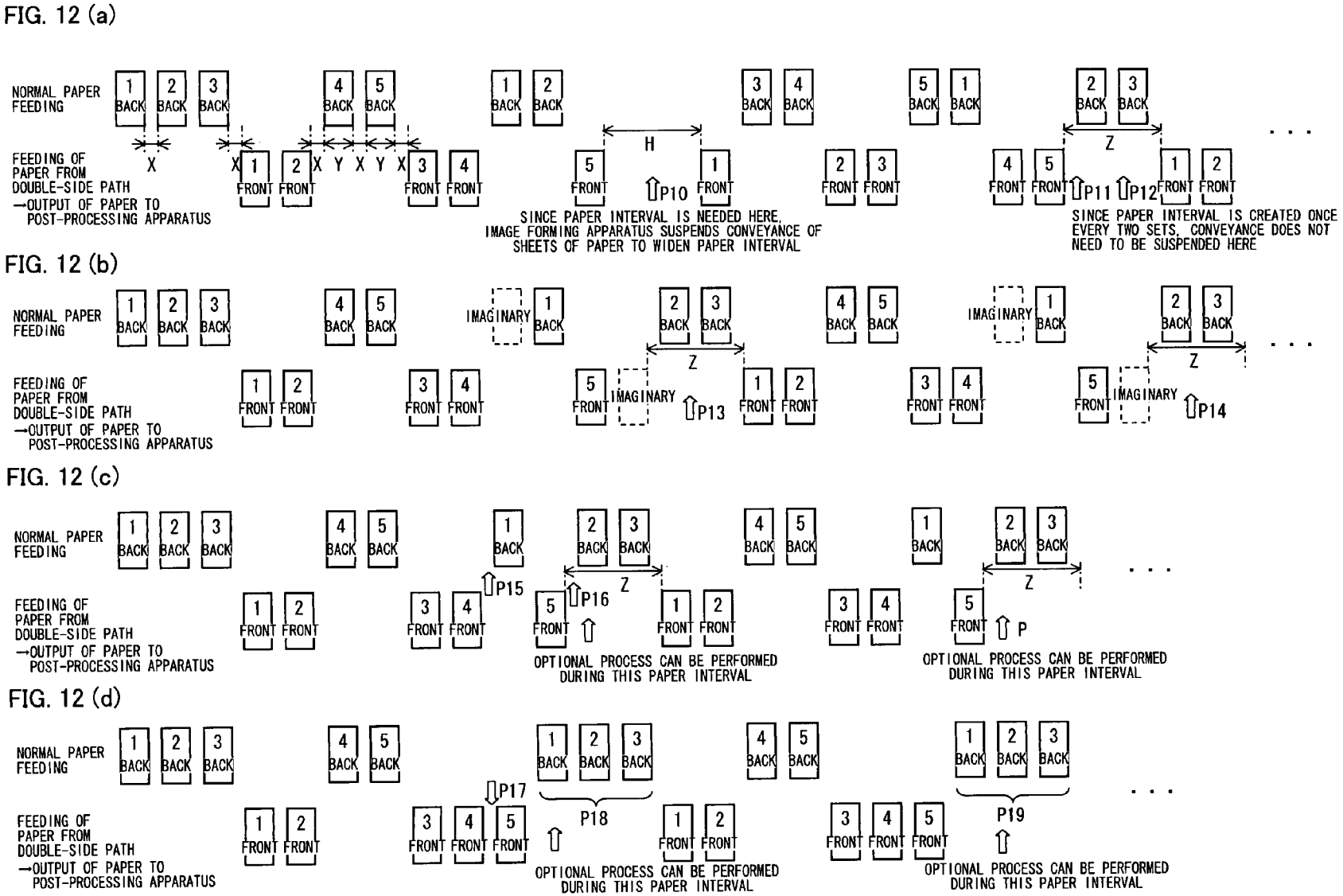
FIGS. 12(*a*) through 12(*d*) are timing charts showing schedules of image formation in the image forming system.

With reference to FIGS. 12(*a*) through 12(*d*), the following describes a schedule of image formation according to the normal sequence and schedules of image formation according to the third and fourth sequences.

FIGS. 12(*a*) through 12(*d*) show four types of schedule of image formation that is performed in cases where the image forming system 100 according to the present embodiment performs two or more jobs of forming images on both sides of each of five sheets of A4 paper (copying of five double-sided documents or double-side copying of ten single-sided documents). Each of the sheets of paper is conveyed transversely in a conveying direction parallel to the shorter sides thereof.

Also in each of FIGS. 12(*a*) through 12(*d*), the horizontal axis represents passage of time. Further, the upper row represents normal paper feeding, and the lower row represents paper feeding by which sheets of paper are fed from the third paper conveying path 36' and paper output by which sheets of paper are outputted to the post-processing apparatus 3. Further, FIGS. 12(*a*) through 12(*d*) are the same as FIGS. 6(*a*) through 6(*d*) in that each of the quadrangles □ represents a sheet of A4 paper to be conveyed transversely, that the numbers enclosed in the quadrangles □ represent the order of documents, and that each of the words "FRONT" and "BACK" enclosed in the quadrangles □ indicates whether the front-side or back-side image of a double-sided document is formed on the sheet of paper.

First, FIG. 12(*a*) shows a schedule of image formation according to the normal sequence. According to this, the first, second, and third sheets of paper of the first set are normally fed in succession. On the first sheet of paper, the back-side image of the first document is formed when the first sheet of paper passes through the image forming position 30 for the first time. Then, on the second sheet of paper, the back-side image of the second document is formed when the second sheet of paper passes through the image forming position 30 for the first time. Then, on the third sheet of paper, the back-side image of the third document is formed when the third sheet of paper passes through the image forming position 30 for the first time.

It should be noted here that one sheet of paper is conveyed after another sheet of paper with a predetermined distance X therebetween. The present image forming apparatus 101 is also capable of forming an image on one side of each of 110 sheets of A4 paper in transverse conveyance and outputting the sheets of paper per minute, for example. In that case, the paper interval is X. Each of FIGS. 12(*a*) through 12(*d*) shows a state where the image forming apparatus 101 is driven to double-side image formation with the same 100% performance as single-side image formation, which forms an image on one side of each of 110 sheets of A4 paper in transverse conveyance and outputs the sheets of paper per minute. In the case where the paper interval is X, the registration roller 32 only instantaneously suspends the conveyance of sheets of paper.

Meanwhile, the first and second sheets of paper, on which the back-side images have been formed respectively, are sequentially sent to the third paper conveying path 36', and then reconveyed to the image forming position 30 in succession to the third sheet of paper, which is passing through the image forming position 30 for the first time, each with a paper interval X therebetween. Then, on the first sheet of paper, the front-side image of the first document is formed when the first sheet of paper passes through the image forming position 30 for the second time. Then, on the second sheet of paper, the front-side image of the second document is formed when the second sheet of paper passes through the image forming position 30 for the second time. After that, the first and second sheets of paper are outputted to the post-processing apparatus 3 in succession.

Meanwhile, the third sheet of paper is kept waiting in the third paper conveying path 36', and the fourth and fifth sheets of paper are normally fed to be conveyed after the second sheet of paper, which is passing through the image forming position 30 for the second time, each with a paper interval X therebetween. On the fourth sheet of paper, the back-side image of the fourth document is formed when the fourth sheet of paper passes through the image forming position 30 for the first time. On the fifth sheet of paper, the back-side image of the fifth document is formed when the fifth sheet of paper passes through the image forming position 30 for the first time.

The third sheet of paper, which has been kept waiting in the third paper conveying path 36', is conveyed after the fifth sheet of paper, which is passing through the image forming position 30 for the first time, with a paper interval X therebetween. After that, the front-side image of the third document is formed on the third sheet of paper when the third sheet of paper passes through the image forming position 30 for the second time, and then the third sheet of paper is outputted to the post-processing apparatus 3. It should be noted here that the paper interval between the third sheet of paper and the second sheet of paper outputted ahead equals to a distance Z. The distance Z is obtained by adding three paper intervals X to a distance corresponding to the size Y of the two sheets of paper in the conveying direction.

Then, after the third sheet of paper, the fourth sheet of paper is conveyed with a paper interval X therebetween. On the fourth sheet of paper, the front-side image of the fourth document is formed when the fourth sheet of paper passes through the image forming position 30 for the second time. After that, the fourth sheet of paper is outputted to the post-processing apparatus 3 in succession to the third sheet of paper. Meanwhile, the fifth sheet of paper, which has been normally fed in succession to the fourth sheet of paper, is kept waiting in the third paper conveying path 36'. After the fourth sheet of paper, the first and second sheets of paper of the second set are normally fed in succession.

On the first and second sheets of paper of the second set, the back-side images of the first and second documents are formed when the first and second sheets of paper of the second set pass through the image forming position 30 for the first time, respectively. The fifth sheet of paper, which has been kept waiting in the third paper conveying path 36', is conveyed after the second sheet of paper, which is passing through the image forming position 30 for the first time, each with a paper interval X therebetween. After that, the front-side image of the fifth document is formed on the fifth sheet of paper when the fifth sheet of paper passes through the image forming position 30 for the second time, and then the fifth sheet of paper is outputted to the post-processing apparatus 3.

Then, when the fifth sheet of paper of the first set, i.e., the last sheet of paper of the first set is outputted to the post-processing apparatus 3, the post-processing apparatus 3 performs a post-process on these five sheets of paper (see P10). While the post-processing apparatus 3 is performing the post-process on the first set, the first and second sheets of paper, on which the back-side images of the first and second documents have been formed respectively, of the second set are kept waiting in the third paper conveying path 36', and then suspended until completion of the post-process for the first set. It should be noted that the first sheet of paper is suspended by the registration roller 32 while the second sheet of paper is suspended by another conveying roller.

The registration roller 32 resumes the conveyance of the first sheet of paper of the second set, for example, at such timing that the first sheet of paper of the second set is outputted to the post-processing apparatus 3 at a point of time where the post-processing apparatus 3 has finished the post-process for the first set and become ready to accept the second set of sheets of paper.

The schedule shown in FIG. 12(*a*) shows an example where the paper interval H, which is required for a post-process, is the same distance as the aforementioned paper interval Z, which corresponds to the amount of time required to form images on two sheets of paper.

On the first sheet of paper of the second set, the front-side image of the first document is formed when the resumption of conveyance causes the first sheet of paper of the second set to pass through the image forming position 30 for the second time. After that, the first sheet of paper of the second set is outputted to the post-processing apparatus 3. The second sheet of paper, which has been fed in succession to the first sheet of paper, is kept waiting in the third paper conveying path 36'. After the first sheet of paper passing through the image forming position 30 for the second time, the third and fourth sheets of paper to the second set are normally fed in succession to be conveyed.

Moreover, as evidenced from the boundary between the second and third sets, even if the number of sheets of paper that constitute a single set is an odd number, the fifth sheet of paper of the second set, i.e., the last sheet of paper of the second set is fed in succession to the first sheet of paper of the third set, and then outputted to together in succession to the fourth sheet of paper of the second set without being kept waiting in the third paper conveying path 36'. As a corollary, the second and third sets are placed with the aforementioned paper interval Z therebetween (see P11). This makes it possible to perform a post-process on the second set with use of the paper interval Z. Therefore, the image forming apparatus 101 does not suspend image formation of the third set for a post-process for the second set (see P12).

Although not assumed in FIG. 12(*a*), in cases where the amount of post-processing time is larger than the amount of time required to output two sheets of paper (i.e., the amount of time required to form an image on one side of each of two sheets of paper), which corresponds an paper interval Z, it is necessary to further increase the paper interval by delaying the timing of normal feeding of the first sheet of paper of the third set by the amount of time that exceeds the amount of time required to form an image on one side of each of two sheets of paper.

Thus, in subjecting plural sets to double-side image formation jobs that require post-processes, the normal sequence makes it possible that in cases where the number of sheets of paper that constitute a single set is an odd number of not less than five, a period of time during which images are formed on both sides of each of the second and third sheets of paper of the next set is spent on a post-process once every two sets, as with the second and third sets. However, it is necessary to suspend the conveyance of sheets of paper at least once every two sets, as with the first and second sets, in order to allow time for post-processing. Therefore, in cases where the image forming system 100 is constituted by equipping the image forming apparatus 101 with the post-processing apparatus 3, the image forming apparatus 101 cannot perform to the best of its potential, thus decreasing in productivity.

Also in subjecting plural sets to double-side image formation jobs that require post-processes, it is possible that in cases where the number of sheets of paper that constitute a single set is an even number, a period of time during which an image is formed on a first side of each of the second and third sheets of paper of the next set is necessarily spent on a post-process. Therefore, the image forming system 100 does not waste the potential of the image forming apparatus 101, provided the amount of post-processing time is not larger than the amount of time required to form an image on one side of each of two sheets of paper.

The inventor of the present invention diligently studied to increase the productivity of such an image forming system 100 that, in cases where the number of sheets of paper that constitute a single set is an odd number of not less than five, subjects plural sets to double-side image formation jobs that require post-processes. In the result, the inventor devised three types of schedule of image formation as shown in FIGS. 12(*b*) through 12(*d*).

FIG. 12(*b*) shows the first schedule that the inventor devised. According to this, the number of sheets of paper that constitute the first set is made to be an even number of not less than five by placing an imaginary sheet of paper behind the fifth sheet of paper of the first set. The phrase "placing an imaginary sheet of paper" here means that the timing of feeding and conveyance of sheets of paper and the order in which images are formed are controlled as if there existed a sheet of paper and images were formed on both sides of the sheet of paper, although the imaginary sheet of paper is neither fed nor subjected to image formation.

With this, the schedule is the same as in the case where plural sets of six sheets of paper are subjected to double-side image formation jobs.

Indeed, this makes it possible that by performing a process as if the number of sheets of paper that constitute a single set were an even number, a period of time during which images are formed on one side of each of the second and third sheets of paper of the second set can be necessarily spent on a post-process (see P13 and P14).

However, in this case, as evidenced by a comparison between the timing of normal feeding of the second sheet of paper of the third set and the timing of normal feeding of the second sheet of paper of the third set of FIG. 12(*a*), the start of image formation of the third set is delayed by the amount of time required to form images on one side of each of two sheets of paper. This is because placing the imaginary sheet of paper causes an increase in amount of time required for image formation per set.

FIG. 12(*c*) shows a schedule, intended to remedy such a problem with the schedule of FIG. 12(*b*) that the placement of an imaginary sheet of paper causes an increase in amount of processing time, which conforms to the third sequence.

According to this, first, because the sixth sheet of paper is an imaginary sheet of paper, the timing of normal feeding of the first sheet of paper of the second set is put ahead so that the first sheet of paper of the second set is conveyed after the fourth sheet of paper, which passes through the image forming position 30 for the second time after being conveyed from the third paper conveying path 36', with a paper interval X therebetween (see P15). Then, after the first sheet of paper of the second set, the fifth sheet of paper, which has been kept waiting in the third paper conveying path 36', of the first set is conveyed with a paper interval X therebetween. On the fifth sheet of paper, the front-side image of the fifth document is formed when the fifth sheet of paper passes through the image forming position 30 for the second time. After that, the fifth sheet of paper is outputted.

Furthermore, because the sixth sheet of paper to be conveyed from the third paper conveying path 36 is an imaginary sheet of paper, the timing of feeding of the second and third sheets of paper, which are to be normally fed next, of the second set is also put ahead so that the second and third sheets of paper are conveyed after the fifth sheet of paper, which passes through the image forming position 30 for the second time after being conveyed from the third paper conveying path 36, each with a paper interval therebetween (see P16).

With this, as in the case where the number of sheets of paper that constitute a single set is an even number, a period of time during which an image is formed on one side of each of the second and third sheets of paper of the next set can be used to perform a post-process on the previous set. Moreover, as evidenced by a comparison between the timing of normal feeding of the second sheet of paper of the third set in FIG. 12(*a*) and the timing of normal feeding of the second sheet of paper of the third set in FIG. 12(*c*), the amount of processing time can be shortened by the amount of time required to form images on one side of each of two sheets of paper.

As with FIG. 12(*c*), FIG. 12(*d*) also shows a schedule, intended to remedy such a problem with the schedule of FIG. 12(*b*) that the placement of an imaginary sheet of paper causes an increase in amount of processing time, which conforms to the fourth sequence.

According to the schedule shown in FIG. 12(*c*), after the third and fourth sheets are outputted in succession, the first sheet of the second set is normally fed. After that, the fifth sheet of paper, which has been kept waiting in the third paper conveying path 36', is conveyed so as to be outputted. According to the schedule shown in FIG. 12(*d*), after the third and fourth sheets of paper to be outputted in succession, the fifth sheet of paper, which has been kept waiting in the third paper conveying path 36', is conveyed (see P17) so that the three sheets of paper are outputted in succession. Moreover, it is ensured that the first three sheets of paper of each set are fed in succession (see P18 and P19).

According to this, a period of time during which an image is formed on one side of each of the first, second, and third sheets of paper of the next set can be used to perform a post-process on the previous set. Moreover, as evidenced by a comparison between the timing of normal feeding of the second sheet of paper of the third set in FIG. 12(*a*) and the timing of normal feeding of the second sheet of paper of the third set in FIG. 12(*d*), the amount of processing time can be shortened by the amount of time required to form images on one side of each of two sheets of paper. It should be noted that the same amount of time can be reduced as in the case of the third schedule shown in FIG. 12(*c*).

Figure 13:
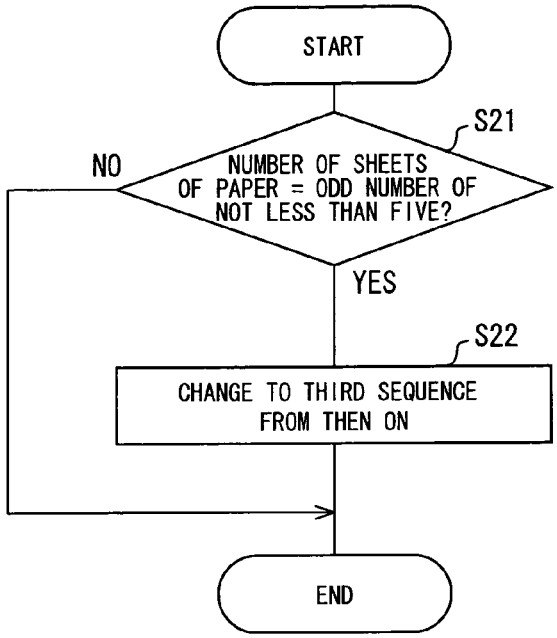
FIG. 13 shows a control flow for making a change of sequences for image formation in the image forming system.
Figure 14:
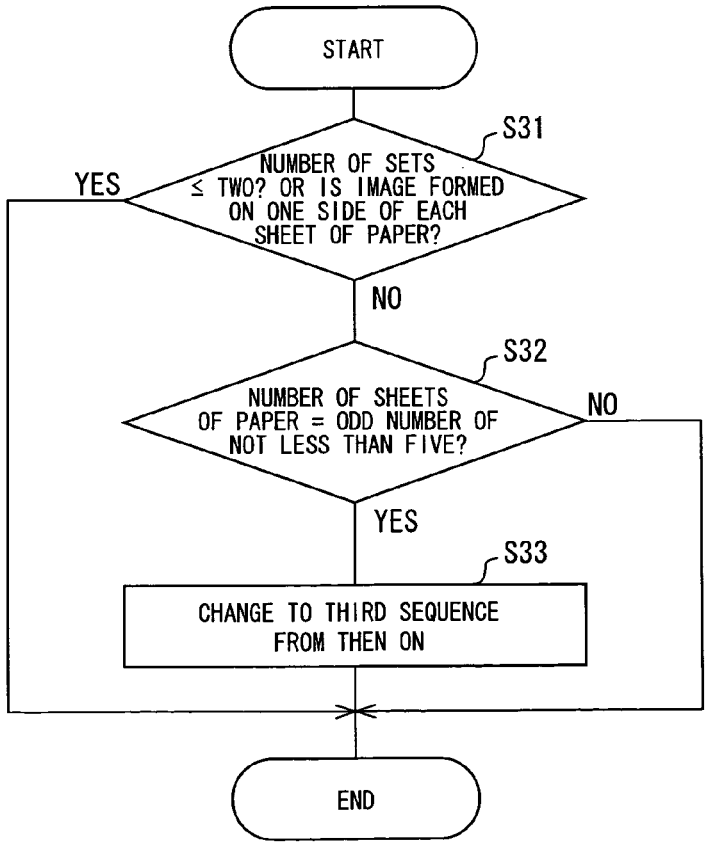
FIG. 14 shows another control flow for making a change of sequences for image formation in the image forming system.

FIGS. 13 and 14 each show a control flow by which the sequence control section 98 makes a change of sequences. Among them, FIG. 13 shows a case where it is possible to judge from the first set on completion of scanning of document images whether images are formed on an odd number of sheets of paper.

In cases where either the amount of post-processing time M is acquired from the post-processing apparatus 3 or the amount of post-processing time M is managed in the PCU 52 after the completion of scanning of document images, the flow is started once the amount of post-processing time M is determined. The flow is performed in the case of double-side image formation.

First, it is judged whether or not the number of sheets of paper that constitute a single set is an odd number of not less than five (S21). In cases where the number is an even number or an odd number of less than five, it is not necessary to change the sequence. Therefore, the flow is finished.

On the other hand, when it is judged in S21 that the number is an odd number of not less than five, the flow proceeds to S22. Subsequently, the sequence is changed to the third sequence, whose schedule is shown in FIG. 12(*c*). Thus, the flow is finished.

In S22, the sequence may be changed to the fourth sequence, whose schedule is shown in FIG. 12(*d*).

Meanwhile, according to FIG. 14, in the case of a model that starts image formation while scanning document images, the need for changing the sequence cannot be determined, because the scanning of document images is not completed during image formation of the first set.

In cases where either the amount of post-processing time M is acquired from the post-processing apparatus 3 or the amount of post-processing time M is managed in the PCU 52 after the completion of scanning of document images during the image formation of the first set, the flow is started once the amount of post-processing time M is determined.

First, in cases where the first set is started after completion of scanning of document images, it is judged whether the number of sets is not more than two or whether an image is formed on one side of a sheet of paper (S31). The reason why it is judged here whether the number of sets is not more than two is as follows: In cases where the number of sets is two, only one set is subjected to image formation after it is determined that the number of sheets of paper is an odd number; therefore, there is no room for improvement of efficiency even if the sequence is changed.

When it is judged in S31 that the number of sets is greater than two, it is judged whether or not the number of sheets of paper that constitute each set is an odd number of not less than five (S32). In cases where the number is an even number or an odd number of less than five, it is not necessary to change the sequence. Therefore, the flow is finished.

On the other hand, when it is judged in S32 that the number is an odd number of not less than five, the flow proceeds to S33. Subsequently, the sequence is changed to the third sequence, whose schedule is shown FIG. 12(*c*). Thus, the flow is finished.

In S33, as in S22, the sequence may be changed to the fourth sequence, whose schedule is shown in FIG. 12(*d*).

Finally, each block of the image forming systems 1 and 100 or, in particular, the sequence control sections 90 and 98, the merit judgment section 92, and the conditional judgment sections 91 and 97 may be constituted by hardware logic, or may be realized by software with use of a CPU in the following manner.

That is, each of the image forming systems 1 and 100 includes: a CPU (central processing unit) for executing an instruction of a control program for realizing various functions; a ROM (read-only memory) in which the program has been stored; a RAM (random access memory) for expanding the program; and a storage device (recording medium), such as a memory, in which the program and various data are stored. The object of the present invention can also be achieved by providing each of the image forming system 1 with a recording medium in which a program code (executable program, intermediate code, or source program) of the control program of each of the image forming system 1 has been stored in a computer-readable manner, and by causing the computer (CPU or MPU) to read and execute the program code stored in the storage medium, the program code serving as software for realizing the aforementioned functions.

Examples of the storage medium include: a tape such as a magnetic tape or a cassette tape; a magnetic disk such as a Floppy® disk or a hard disk; an optical disk such as a CD-ROM, an MO, an MD, a DVD, or a CD-R; a card such as an IC card (inclusive of a memory card) or an optical card; and a semiconductor memory such as a mask ROM, an EPROM, an EEPROM, or a flash ROM.

Further, each of the image forming systems 1 and 100 may be arranged so as to be connectable to a communication network so that the program code is supplied to each of the image forming systems 1 and 100 through the communication network. The communication network is not particularly limited. Examples of the communication network include, but are not particularly limited to, the Internet, an intranet, an extranet, a LAN, an ISDN, a VAN, a CATV communication network, a virtual private network, a telephone network, a mobile communication network, and a satellite communication network. Further, usable examples of a transmission medium that constitutes the communication network include, but are not particularly limited to, a cable medium such as IEEE 1394, a USB, power line communication, a cable TV line, a telephone line, or an ADSL line and a wireless medium such as IrDA, infrared rays used for a remote controller, Bluetooth®, IEEE 802.11, HDR, a mobile phone network, satellite connection, or a terrestrial digital network. It should be noted that the present invention can also be realized in the form of a computer data signal realized by electronic transmission of the program code and embedded in a carrier wave.

The present invention is not limited to the description of the embodiments above, but may be altered by a skilled person within the scope of the claims. An embodiment based on a proper combination of technical means disclosed in different embodiments is encompassed in the technical scope of the present invention.

As described above, an image forming apparatus of the present invention an image forming apparatus of the present invention is an image forming apparatus, including (i) a paper feeding section in which a sheet of paper is stored, (ii) an image forming section for performing image formation on a sheet of paper, (iii) an output section for outputting, from the apparatus, a sheet of paper subjected to image formation, (iv) a main conveying path extending from the paper feeding section to the output section via the image forming section, and (v) a sub-conveying path through which a sheet of paper having one side finished with image formation is guided to an upstream side of the image forming section from an upstream side of the output section in the main conveying path, which constitutes an image forming system by being equipped with a post-processing apparatus for performing a post-process on a sheet of paper outputted from the output section, the image forming apparatus including: conditional judgment means (conditional judgment section) for judging whether or not conditions for image formation are as follows: (1) double-side image formation is performed, i.e., images are formed on both sides of a sheet of paper; (2) the number of sheets of paper that constitute a single set is an odd number; (3) the number of sets is not less than two; and (4) it is necessary to delay image formation of the next set in order to perform a post-process on the previous set outputted ahead; and sequence control means (sequence control section) for, when the conditional judgment means judges that double-side image formation is performed, that the number of sheets of paper of a single set is an odd number, that the number of sets is not less than two, and that it is necessary to delay image formation of the next set, making a change of sequences for performing double-side image formation on plural sets of sheets of paper in succession, so as to make it possible to perform image formation on the next set while performing a post-process on the previous set.

According to this, the conditional judgment means judges whether or not conditions for image formation are as follows: (1) double-side image formation is performed, i.e., images are formed on both sides of a sheet of paper; (2) the number of sheets of paper that constitute a single set is an odd number; (3) the number of sets is not less than two; and (4) it is necessary to delay image formation of the next set in order to perform a post-process on the previous set outputted ahead.

Then, when the conditional judgment means judges that double-side image formation is performed, that the number of sheets of paper of a single set is an odd number, that the number of sets is not less than two, and that it is necessary to delay image formation of the next set, the sequence control means makes a change of sequences for performing double-side image formation on plural sets of sheets of paper in succession, so as to make it possible to perform image formation on the next set while performing a post-process on the previous set.

This makes it possible not to delay image formation of the next set (image formation job) in order to allow post-processing time for the previous set (image formation job), or to minimize the duration of a delay, if any. An image forming system constituted by such an image forming apparatus does not waste the performance of the image forming apparatus, thus enabling improvement in productivity.

The sequence control means can be easily realized, for example, by being arranged so as to include (a) timing adjustment means (timing adjustment section) for adjusting timing of feeding and conveyance of sheets of paper by controlling paper conveying mechanisms respectively provided alongside the main conveying path and the sub-conveying path and (b) order adjustment means (order adjustment section) for controlling the image forming section to adjust an order in which images are formed.

Specifically, the sequence control means changes from a normal sequence to such a first or second sequence as described below. The normal sequence is a sequence for: feeding two sheets of paper at a time in succession from the paper feeding section regardless of difference in set of sheets of paper; after sequentially forming images on respective first surfaces of the two sheets of paper thus fed, sequentially forming images on respective second surfaces of the two sheets of paper and outputting the two sheets of paper in succession; and feeding the next two sheets of paper in succession.

The first sequence is a sequence for: feeding two sheets of paper at a time in succession until the last sheet of paper of a set of sheets of paper is detected; after sequentially forming images on respective first sides of the two sheets of paper thus fed, sequentially forming images on respective second sides of the two sheets of paper and outputting the two sheets of paper in succession; feeding the next two sheets of paper in succession; feeding only the last sheet of paper of the set of sheets of paper; immediately after forming an image on a first side of the sheet of paper thus fed, forming an image on a second side of the sheet of paper and outputting only the sheet of paper.

According to the first sequence, a period of time during which an image is formed on a first side of each of the first and second sheets of paper of the next set can be spent on a post-process for the previous set as in the case where the number of sheets of paper that constitute a single set is an even number.

The second sequence is a sequence for: feeding only the first sheet of paper of a set of sheets of paper from the paper feeding section; immediately after forming an image on a first side of the sheet of paper thus fed, forming an image on a second side of the sheet of paper and outputting only the sheet of paper; subsequently feeding two sheets of paper at a time in succession until the first sheet of paper of the next set is detected; after sequentially forming images on respective first sides of the two sheets of paper thus fed, sequentially forming images on respective second sides of the two sheets of paper and outputting the two sheets of paper in succession; and feeding the next two sheets of paper in succession.

According to the second sequence, the first sheet of paper of a set of sheets of paper is necessarily fed alone, has images formed on both sides thereof, and then is outputted to the post-processing apparatus 3. Therefore, a period of time during which an image is formed on a first side of the first sheet of paper and the lost time, which is a difference between the amount of time required to form an image on one side of each sheet of paper and the amount of time required to feed and convey only a single sheet of paper, form images on both sides of the sheet of paper, and output the sheet of paper alone, can be spent on a post-process for the previous set.

The image forming apparatus of the present invention is preferably arranged so as to further include merit judgment means for determining the existence of a merit by making a comparison between (i) a value obtained by doubling lost time that is a difference between the amount of time required to form an image on one side of each sheet of paper and the amount of time required to feed and convey only one sheet of paper, form images on both sides of the sheet of paper, and output the sheet of paper alone, and (ii) the amount of post-processing time required to perform a post-process on a single set, wherein the sequence control means makes a change of sequences when the merit judgment means judges that there is a merit.

The reason for this is as follows: the change from the normal sequence to the first or second sequence does not necessarily bring about a merit in terms of time; and in the case of a short post-processing time, a change of sequences may result in lower productivity on the contrary.

That is, for each set of sheets of paper, the first or second sequence necessarily feeds and conveys a single sheet of paper alone, forms images on both sides of the sheet of paper, and then outputs the sheet of paper. Therefore, each set of sheets of paper incurs lost time that is a difference between the amount of time required to form an image on one side of each sheet of paper and the amount of time required to feed and convey a sheet of paper alone, form images on both sides of the sheet of paper, and output the sheet of paper.

Meanwhile, even when the number of sheets of paper that constitute a single set of double-side image formation is an odd number, a period of time during which an image is formed on a first side of each of the first and second sheet of paper of the next set can be necessarily spent on a post-process once every two sets, as in the case where the number of sheets of paper is an even number. Therefore, it is once every two sets that image formation is suspended for the purpose of allowing time for post-processing.

Therefore, in cases where the amount of post-processing time is larger than a value obtained by doubling the lost time incurred by each set of sheets of paper, the merit of time reduction is brought about by feeding and conveying a single sheet of paper alone, forming images on both sides of the sheet of paper, and then outputting the sheet of paper.

According to the foregoing arrangement, the merit judgment means determines the existence of a merit by making a comparison between (i) a value obtained by doubling lost time that is a difference between the amount of time required to form an image on one side of each sheet of paper and the amount of time required to feed and convey only one sheet of paper, form images on both sides of the sheet of paper, and output the sheet of paper alone, and (ii) the amount of post-processing time required to perform a post-process on a single set, and the sequence control means changes from the normal sequence to the first or second sequence only when the merit judgment means judges that there is a merit. This makes it possible to surely avoid decline in productivity.

Further, as another example, there is an arrangement in which: the conditional judgment means also judges whether or not the number of sheets of paper that constitute a single set is an odd number of not less than five; and when the conditional judgment means judges, in addition to the above conditions, that the number of sheets of paper is an odd number of not less than five, the sequence control means changes from a normal sequence to such a third or fourth sequence as described below. The normal sequence is a sequence for: feeding only the first three sheets of paper of the first set in succession from the paper feeding section; sequentially forming images on respective first sides of the three sheets of paper thus fed; sequentially forming images on respective second sides of the first and second sheets of paper and outputting them in succession, while keeping the third sheet of paper waiting in the sub-conveying path; feeding two sheets of paper at a time in succession regardless of difference in set of sheets of paper, starting from the second paper feeding; sequentially forming images on respective first sides of the two sheets of paper thus fed; conveying the first one of the two sheets of paper in succession to the third sheet of paper kept waiting, sequentially forming images on respective second sides thereof, and outputting them in succession, while keeping the second one of the two sheets of paper waiting in the sub-conveying path; and feeding the next two sheets of paper in succession.

The third sequence is a sequence for: feeding only the first three sheets of paper of the first set in succession from the paper feeding section; sequentially forming images on respective first sides of the three sheets of paper thus fed; sequentially forming images on respective second sides of the first and second sheets of paper and outputting them in succession, while keeping the third sheet of paper waiting in the sub-conveying path; feeding two sheets of paper at a time in succession, starting from the second paper feeding; sequentially forming images on respective first sides of the two sheets of paper thus fed; conveying the first one of the two sheets of paper in succession to the third sheet of paper kept waiting, sequentially forming images on respective second sides thereof, and outputting them in succession, while keeping the second one of the two sheets of paper waiting in the sub-conveying path; feeding the next two sheets of paper; sequentially forming images on respective first sides of the two sheets of paper thus fed, upon finishing feeding the last sheet of paper of the first set from the paper feeding section; conveying the first one of the two sheets of paper in succession to the second sheet of paper kept waiting in the sub-conveying path, sequentially forming images on respective second sides thereof, and outputting them in succession, while keeping the last sheet of paper waiting in the sub-conveying path; feeding only one sheet of paper from the paper feeding section then; forming an image on a first side of the sheet of paper thus fed and then keeping the sheet of paper waiting in the sub-conveying path; conveying only the last sheet of paper, which have been kept waiting, of the first set, forming an image on a second side of the last sheet of paper, and outputting only the last sheet of paper; and feeding two sheets of paper at a time in succession again from then on.

According to the third sequence, a period of time during which an image is formed on a first side of each of the second and third sheets of paper of the next set can be spent on a post-process for the previous set.

Further, the fourth sequence is a sequence for: feeding only the first three sheets of paper of each set in succession from the paper feeding section; sequentially forming images on respective first sides of the three sheets of paper thus fed; sequentially forming images on respective second sides of the first and second sheet of paper and outputting them in succession, while keeping the third sheet of paper waiting in the sub-conveying path; feeding two sheets of paper at a time in succession, starting from the second paper feeding; sequentially forming images on respective first sides of the two sheets of paper thus fed; conveying the first one of the two sheets of paper in succession to the third sheet of paper kept waiting, sequentially forming images on respective second sides thereof, and outputting them in succession, while keeping the second one of the two sheets of paper waiting in the sub-conveying path; feeding the next two sheets of paper; sequentially forming images on respective first sides of the two sheets of paper thus fed, upon finishing feeding the last sheet of paper of the set from the paper feeding section; and conveying the first and second sheets of paper in succession to the sheet of paper kept waiting in the sub-conveying path, sequentially forming images on respective second sides of the three sheets of paper, and outputting them in succession, without keeping the last sheet of paper, i.e., the second sheet of paper waiting in the sub-conveying path.

According to such a fourth sequence, a period of time during which an image is formed on a first side of each of the first, second, and third sheets of paper of the next set can be spent on a post-process for the previous set.

In order to solve the foregoing problems, an image forming system of the present invention is an image forming system including: an image forming apparatus provided with (i) a paper feeding section in which a sheet of paper is stored, (ii) an image forming section for performing image formation on a sheet of paper, (iii) an output section for outputting, from the apparatus, a sheet of paper subjected to image formation, (iv) a main conveying path extending from the paper feeding section to the output section via the image forming section, and (v) a sub-conveying path through which a sheet of paper having one side finished with image formation is guided to an upstream side of the image forming section from an upstream side of the output section in the main conveying path; and a post-processing apparatus for performing a post-process on a sheet of paper outputted from the output section, the image forming system including: conditional judgment means for judging whether or not conditions for image formation are as follows: (1) double-side image formation is performed, i.e., images are formed on both sides of a sheet of paper; (2) the number of sheets of paper that constitute a single set is an odd number; (3) the number of sets is not less than two; and (4) it is necessary to delay image formation of the next set in order to perform a post-process on the previous set outputted ahead; and sequence control means for, when the conditional judgment means judges that double-side image formation is performed, that the number of sheets of paper of a single set is an odd number, that the number of sets is not less than two, and that it is necessary to delay image formation of the next set, changing (i) timing of feeding and conveyance of sheets of paper and (ii) an order in which images are formed in performing double-side image formation on plural sets of sheets of paper in succession, so as to make it possible to perform image formation on the next set while performing a post-process on the previous set.

As already described as an image forming apparatus, this makes it possible to realize a highly productive image forming system that does not waste the performance of the image forming apparatus.

Furthermore, the present invention encompasses a program for causing a compute to function as each means of the image forming apparatus of the present invention and a computer-readable recording medium containing the program.

That is, each means of the image forming apparatus may be realized by hardware, or may be realized by causing a computer to execute a program. Specifically, a program according to the present invention is a program that operates a computer as each means described above, and a recording medium according to the present invention has the program recorded therein.

When these programs are executed by a computer, the computer operates as each means of the image forming apparatus, thus bringing about the same effect as each means of the image forming system.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus, including (i) a paper feeding section in which a sheet of paper is stored, (ii) an image forming section for performing image formation on a sheet of paper, (iii) an output section for outputting, from the apparatus, a sheet of paper subjected to image formation, (iv) a main conveying path extending from the paper feeding section to the output section via the image forming section, and (v) a sub-conveying path through which a sheet of paper having one side finished with image formation is guided to an upstream side of the image forming section from an upstream side of the output section in the main conveying path, which constitutes an image forming system by being equipped with a post-processing apparatus for performing a post-process on a sheet of paper outputted from the output section, the image forming apparatus comprising:

conditional judgment means for judging whether or not conditions for image formation are as follows: (1) double-side image formation is performed, i.e., images are formed on both sides of a sheet of paper; (2) the number of sheets of paper that constitute a single set is an odd number; (3) the number of sets is not less than two; and (4) it is necessary to delay image formation of the next set in order to perform a post-process on the previous set outputted ahead; and sequence control means for, when the conditional judgment means judges that double-side image formation is performed, that the number of sheets of paper of a single set is an odd number, that the number of sets is not less than two, and that it is necessary to delay image formation of the next set, making a change of sequences for performing double-side image formation on plural sets of sheets of paper in succession, so as to make it possible to perform image formation on the next set while performing a post-process on the previous set.

2. The image forming apparatus as set forth in claim 1, wherein the sequence control means includes (a) timing adjustment means for adjusting timing of feeding and conveyance of sheets of paper by controlling paper conveying mechanisms respectively provided alongside the main conveying path and the sub-conveying path and (b) order adjustment means for controlling the image forming section to adjust an order in which images are formed.

3. The image forming apparatus as set forth in claim 1, wherein the sequence control means changes from a normal sequence to a first sequence, the normal sequence being a sequence for: feeding two sheets of paper at a time in succession from the paper feeding section regardless of difference in set of sheets of paper; after sequentially forming images on respective first surfaces of the two sheets of paper thus fed, sequentially forming images on respective second surfaces of the two sheets of paper and outputting the two sheets of paper in succession; and feeding the next two sheets of paper in succession, the first sequence being a sequence for: feeding two sheets of paper at a time in succession until the last sheet of paper of a set of sheets of paper is detected; after sequentially forming images on respective first sides of the two sheets of paper thus fed, sequentially forming images on respective second sides of the two sheets of paper and outputting the two sheets of paper in succession; feeding the next two sheets of paper in succession; feeding only the last sheet of paper of the set of sheets of paper; immediately after forming an image on a first side of the sheet of paper thus fed, forming an image on a second side of the sheet of paper and outputting only the sheet of paper.

4. The image forming apparatus as set forth in claim 1, wherein the sequence control means changes from a normal sequence to a second sequence, the normal sequence being a sequence for: feeding two sheets of paper at a time in succession from the paper feeding section regardless of difference in set of sheets of paper; after sequentially forming images on respective first surfaces of the two sheets of paper thus fed, sequentially forming images on respective second surfaces of the two sheets of paper and outputting the two sheets of paper in succession; and feeding the next two sheets of paper in succession, the second sequence being a sequence for: feeding only the first sheet of paper of a set of sheets of paper from the paper feeding section; immediately after forming an image on a first side of the sheet of paper thus fed, forming an image on a second side of the sheet of paper and outputting only the sheet of paper; subsequently feeding two sheets of paper at a time in succession until the first sheet of paper of the next set is detected; after sequentially forming images on respective first sides of the two sheets of paper thus fed, sequentially forming images on respective second sides of the two sheets of paper and outputting the two sheets of paper in succession; and feeding the next two sheets of paper in succession.

5. The image forming apparatus as set forth in claim 3, further comprising merit judgment means for determining the existence of a merit by making a comparison between (i) a value obtained by doubling lost time that is a difference between the amount of time required to form an image on one side of each sheet of paper and the amount of time required to feed and convey only one sheet of paper, form images on both sides of the sheet of paper, and output the sheet of paper alone, and (ii) the amount of post-processing time required to perform a post-process on a single set, wherein the sequence control means makes a change of sequences when the merit judgment means judges that there is a merit.

6. The image forming apparatus as set forth in claim 4, further comprising merit judgment means for determining the existence of a merit by making a comparison between (i) a value obtained by doubling lost time that is a difference between the amount of time required to form an image on one side of each sheet of paper and the amount of time required to feed and convey only one sheet of paper, form images on both sides of the sheet of paper, and output the sheet of paper alone, and (ii) the amount of post-processing time required to perform a post-process on a single set, wherein the sequence control means makes a change of sequences when the merit judgment means judges that there is a merit.

7. The image forming apparatus as set forth in claim 1, wherein:

the conditional judgment means also judges whether or not the number of sheets of paper that constitute a single set is an odd number of not less than five; and the sequence control means changes from a normal sequence to a third sequence when the conditional judgment means judges that the number of sheets of paper is an odd number of not less than five, the normal sequence being a sequence for: feeding only the first three sheets of paper of the first set in succession from the paper feeding section; sequentially forming images on respective first sides of the three sheets of paper thus fed; sequentially forming images on respective second sides of the first and second sheets of paper and outputting them in succession, while keeping the third sheet of paper waiting in the sub-conveying path; feeding two sheets of paper at a time in succession regardless of difference in set of sheets of paper, starting from the second paper feeding; sequentially forming images on respective first sides of the two sheets of paper thus fed; conveying the first one of the two sheets of paper in succession to the third sheet of paper kept waiting, sequentially forming images on respective second sides thereof, and outputting them in succession, while keeping the second one of the two sheets of paper waiting in the sub-conveying path; and feeding the next two sheets of paper in succession, the third sequence being a sequence for: feeding only the first three sheets of paper of the first set in succession from the paper feeding section; sequentially forming images on respective first sides of the three sheets of paper thus fed; sequentially forming images on respective second sides of the first and second sheets of paper and outputting them in succession, while keeping the third sheet of paper waiting in the sub-conveying path;

feeding two sheets of paper at a time in succession, starting from the second paper feeding; sequentially forming images on respective first sides of the two sheets of paper thus fed; conveying the first one of the two sheets of paper in succession to the third sheet of paper kept waiting, sequentially forming images on respective second sides thereof, and outputting them in succession, while keeping the second one of the two sheets of paper waiting in the sub-conveying path; feeding the next two sheets of paper; sequentially forming images on respective first sides of the two sheets of paper thus fed, upon finishing feeding the last sheet of paper of the first set from the paper feeding section; conveying the first one of the two sheets of paper in succession to the second sheet of paper kept waiting in the sub-conveying path, sequentially forming images on respective second sides thereof, and outputting them in succession, while keeping the last sheet of paper waiting in the sub-conveying path; feeding only one sheet of paper from the paper feeding section then; forming an image on a first side of the sheet of paper thus fed and then keeping the sheet of paper waiting in the sub-conveying path; conveying only the last sheet of paper, which have been kept waiting, of the first set, forming an image on a second side of the last sheet of paper, and outputting only the last sheet of paper; and feeding two sheets of paper at a time in succession again from then on.

8. The image forming apparatus as set forth in claim 1, wherein:

the conditional judgment means also judges whether or not the number of sheets of paper that constitute a single set is an odd number of not less than five; and the sequence control means changes from a normal sequence to a third sequence when the conditional judgment means judges that the number of sheets of paper is an odd number of not less than five, the normal sequence being a sequence for: feeding only the first three sheets of paper of the first set in succession from the paper feeding section; sequentially forming images on respective first sides of the three sheets of paper thus fed; sequentially forming images on respective second sides of the first and second sheets of paper and outputting them in succession, while keeping the third sheet of paper waiting in the sub-conveying path; feeding two sheets of paper at a time in succession regardless of difference in set of sheets of paper, starting from the second paper feeding; sequentially forming images on respective first sides of the two sheets of paper thus fed; conveying the first one of the two sheets of paper in succession to the third sheet of paper kept waiting, sequentially forming images on respective second sides thereof, and outputting them in succession, while keeping the second one of the two sheets of paper waiting in the sub-conveying path; and feeding the next two sheets of paper in succession, the fourth sequence being a sequence for: feeding only the first three sheets of paper of each set in succession from the paper feeding section; sequentially forming images on respective first sides of the three sheets of paper thus fed; sequentially forming images on respective second sides of the first and second sheet of paper and outputting them in succession, while keeping the third sheet of paper waiting in the sub-conveying path; feeding two sheets of paper at a time in succession, starting from the second paper feeding; sequentially forming images on respective first sides of the two sheets of paper thus fed; conveying the first one of the two sheets of paper in succession to the third sheet of paper kept waiting, sequentially forming images on respective second sides thereof, and outputting them in succession, while keeping the second one of the two sheets of paper waiting in the sub-conveying path; feeding the next two sheets of paper; sequentially forming images on respective first sides of the two sheets of paper thus fed, upon finishing feeding the last sheet of paper of the set from the paper feeding section; and conveying the first and second sheets of paper in succession to the sheet of paper kept waiting in the sub-conveying path, sequentially forming images on respective second sides of the three sheets of paper, and outputting them in succession, without keeping the last sheet of paper, i.e., the second sheet of paper waiting in the sub-conveying path.

9. An image forming system including: an image forming apparatus provided with (i) a paper feeding section in which a sheet of paper is stored, (ii) an image forming section for performing image formation on a sheet of paper, (iii) an output section for outputting, from the apparatus, a sheet of paper subjected to image formation, (iv) a main conveying path extending from the paper feeding section to the output section via the image forming section, and (v) a sub-conveying path through which a sheet of paper having one side finished with image formation is guided to an upstream side of the image forming section from an upstream side of the output section in the main conveying path; and a post-processing apparatus for performing a post-process on a sheet of paper outputted from the output section, the image forming system comprising:

conditional judgment means for judging whether or not conditions for image formation are as follows: (1) double-side image formation is performed, i.e., images are formed on both sides of a sheet of paper; (2) the number of sheets of paper that constitute a single set is an odd number; (3) the number of sets is not less than two; and (4) it is necessary to delay image formation of the next set in order to perform a post-process on the previous set outputted ahead; and sequence control means for, when the conditional judgment means judges that double-side image formation is performed, that the number of sheets of paper of a single set is an odd number, that the number of sets is not less than two, and that it is necessary to delay image formation of the next set, changing (i) timing of feeding and conveyance of sheets of paper and (ii) an order in which images are formed in performing double-side image formation on plural sets of sheets of paper in succession, so as to make it possible to perform image formation on the next set while performing a post-process on the previous set.

10. A non-transitory computer readable recording medium containing a program for causing a computer to function as each means of an image forming apparatus as set forth in claim 1.

* * * * *